US010309392B2

(12) United States Patent
Choi et al.

(10) Patent No.: US 10,309,392 B2
(45) **Date of Patent: *Jun. 4, 2019**

(54) COMPRESSOR AND METHOD FOR CONTROLLING A COMPRESSOR

(71) Applicant: LG ELECTRONICS INC., Seoul (KR)

(72) Inventors: Jongyoon Choi, Seoul (KR); Sungjin Lim, Seoul (KR); Nayi Ryu, Seoul (KR); Chaehong Lim, Seoul (KR); Seunggeun Baek, Seoul (KR); Hyeongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 177 days.

This patent is subject to a terminal disclaimer.

(21) Appl. No.: 15/335,800

(22) Filed: Oct. 27, 2016

(65) Prior Publication Data

US 2017/0122306 A1 May 4, 2017

(30) Foreign Application Priority Data

Oct. 28, 2015 (KR) ..... 10-2015-0150482

(51) Int. Cl.
*F04B 49/12* (2006.01)
*F04B 35/04* (2006.01)
(Continued)

(52) U.S. Cl.
CPC ..... *F04B 49/12* (2013.01); *F04B 35/04* (2013.01); *F04B 35/045* (2013.01);
(Continued)

(58) Field of Classification Search
CPC ..... F04B 35/045; F04B 2203/0401; F04B 2203/0402; F04B 39/0005;
(Continued)

(56) References Cited

U.S. PATENT DOCUMENTS 5,342,176 A 8/1994 Redlich
6,565,336 B1 * 5/2003 Fraser ..... F04B 39/1073 137/856
(Continued)

FOREIGN PATENT DOCUMENTS

CN 1443280 9/2003
CN 1480649 3/2004
(Continued)

OTHER PUBLICATIONS

European Search Report dated Apr. 3, 2017.
(Continued)

*Primary Examiner* — Kenneth J Hansen
(74) *Attorney, Agent, or Firm* — KED & Associates LLP

(57) ABSTRACT

A linear compressor and a method for controlling a compressor are provided. The compressor may include a piston that reciprocates within a cylinder, a linear motor that supplies a driving force to the piston, a discharge device through which a refrigerant compressed in the cylinder by the reciprocating motion of the piston is discharged, a pressure changing device that changes a variation rate of pressure applied to the piston before the piston reaches a virtual discharge surface (VDS) during the reciprocating motion, to prevent collision between the piston and the discharge device. The virtual discharge surface may be formed on at least a portion of the discharge device facing a compression space within the cylinder.

15 Claims, 17 Drawing Sheets

(51) Int. Cl.

| | |
|---|---|
| ***F04B 49/06*** | (2006.01) |
| ***F04B 53/12*** | (2006.01) |
| ***F04B 53/16*** | (2006.01) |
| ***F04B 39/00*** | (2006.01) |
| ***F04B 39/12*** | (2006.01) |
| ***F04B 49/14*** | (2006.01) |

(52) U.S. Cl.
CPC ..... *F04B 39/0027* (2013.01); *F04B 39/126* (2013.01); *F04B 49/065* (2013.01); *F04B 49/14* (2013.01); *F04B 53/12* (2013.01); *F04B 53/162* (2013.01); *F04B 2203/0401* (2013.01); *F04B 2203/0402* (2013.01)

(58) Field of Classification Search
CPC .. F04B 2201/0201; F04B 17/04; F04B 49/10; F04B 49/12; F04B 49/14; F04B 49/103
USPC ..... 92/169.1–171.1; 417/274, 569, 570
See application file for complete search history.

(56) References Cited

U.S. PATENT DOCUMENTS

| | | | | |
|---|---|---|---|---|
| 7,663,275 | B2 | 2/2010 | McGill et al. | |
| 2003/0175135 | A1* | 9/2003 | Heo | F04B 35/045 417/363 |
| 2004/0047751 | A1 | 3/2004 | Kim et al. | |
| 2006/0070518 | A1 | 4/2006 | McGill et al. | |
| 2007/0241697 | A1 | 10/2007 | Sung et al. | |
| 2011/0008191 | A1 | 1/2011 | Lilie et al. | |
| 2011/0318193 | A1* | 12/2011 | Hu | F04B 35/045 417/44.1 |

FOREIGN PATENT DOCUMENTS

| | | | | |
|---|---|---|---|---|
| CN | 1735749 | | 2/2006 | |
| CN | 1752445 | | 3/2006 | |
| CN | 1755105 | | 4/2006 | |
| CN | 101065578 | | 10/2007 | |
| CN | 101427457 | | 5/2009 | |
| CN | 101755124 | | 6/2010 | |
| CN | 101835980 | | 9/2010 | |
| CN | 101881264 | | 11/2010 | |
| CN | 102741552 | | 10/2012 | |
| CN | 102979697 | | 3/2013 | |
| CN | 104728074 | | 6/2015 | |
| EP | 2 365 221 | | 9/2011 | |
| EP | 2 568 173 | | 3/2013 | |
| KR | 2003-0071359 | | 9/2003 | |
| KR | 10-2007-0095518 | | 10/2007 | |
| KR | 10-1451935 | | 10/2014 | |
| KR | 10-1495185 | | 3/2015 | |
| WO | WO 02/095232 | | 11/2002 | |
| WO | WO 2007/123323 | | 11/2007 | |
| WO | WO 2007123323 | A1 * | 11/2007 | F04B 35/045 |
| WO | WO 2009/054654 | | 4/2009 | |

OTHER PUBLICATIONS

Chinese Office Action dated Jan. 25, 2018 (English Translation).
U.S. Office Action issued in U.S. Appl. No. 15/335,944 dated Jun. 22, 2018.
Chinese Office Action dated Mar. 13, 2018 issued in Application No. 201611007550.1 (with English Translation).
European Search Report dated Mar. 10, 2017 issued in Application No. 16195461.5.
Korean Notice of Allowance dated Oct. 20, 2017.
U.S. Appl. No. 15/335,994, filed Oct. 27, 2016.
Chinese Office Action dated Nov. 26, 2018 with English Translation.

* cited by examiner

COMPRESSOR AND METHOD FOR CONTROLLING A COMPRESSOR

CROSS-REFERENCE TO RELATED APPLICATION(S)

Pursuant to 35 U.S.C. § 119(a), this application claims the benefit of an earlier filing date of and the right of priority to Korean Application No. 10-2015-0150482, filed in Korea on Oct. 28, 2015, the contents of which are incorporated by reference herein in its entirety.

BACKGROUND

1. Field

A compressor and a method for controlling a compressor are disclosed herein.

2. Background

In general, a compressor is an apparatus that converts mechanical energy into compression energy of a compressible fluid, and constitutes a part of a refrigerating device, for example, a refrigerator, or an air conditioner. Compressors are roughly classified into a reciprocating compressor, a rotary compressor, and a scroll compressor. The reciprocating compressor is configured such that a compression space, into and from which an operating gas, such as a refrigerant, is suctioned and discharged, is formed between a piston and a cylinder and the refrigerant is compressed as the linearly reciprocates in the cylinder. The rotary compressor is configured such that a compression space, into and from which an operating gas, such as a refrigerant, is suctioned and discharged, is formed between an eccentrically-rotatable roller and a cylinder and the refrigerant is compressed as the roller eccentrically rotates along an inner wall of the cylinder. The scroll compressor is configured such that a compression space, into and from which an operating gas, such as a refrigerant, is suctioned and discharged, is formed between an orbiting scroll and a fixed scroll and the refrigerant is compressed as the orbiting scroll rotates along the fixed scroll.

The reciprocating compressor sucks, compresses, and discharges a refrigerant by linearly reciprocating the piston within the cylinder. The reciprocating compressor is classified into a recipro type and a linear type according to a method of driving the piston.

The recipro type refers to a type of reciprocating compressor that converts a rotary motion of a motor into a linear reciprocating motion by coupling the motor to a crankshaft and coupling a piston to the crankshaft. On the other hand, the linear type refers to a type of reciprocating compressor that reciprocates a piston using a linear motion of a linearly-moving motor by connecting the piston to a mover of the motor.

The reciprocating compressor includes a motor unit or device that generates a driving force, and a compression unit or device that compresses fluid by receiving the driving force from the motor unit. A motor is generally used as the motor unit, and specifically, the linear type reciprocating compressor uses a linear motor.

The linear motor directly generates a linear driving force, and thus, does not require a mechanical conversion device and a complicated structure. Also, the linear motor may reduce a loss due to energy conversion, and remarkably reduce noise by virtue of the non-existence of a connection portion at which friction and abrasion are caused. Also, when the linear type reciprocating compressor (hereinafter, referred to as a "linear compressor") is applied to a refrigerator or air conditioner, a compression ratio may vary by changing a stroke voltage applied to the linear compressor. Accordingly, the compressor may also be used for a control of varying a freezing capacity.

In the linear compressor, as the piston is reciprocated without being mechanically locked within the cylinder, the piston may collide with (or crash into) a wall of the cylinder when an excessive voltage is applied suddenly, or a compression may not be properly executed when the piston fails to move forward due to a great load. Therefore, a control device for controlling the motion of the piston in response to a variation of the load or voltage is needed.

In general, a compressor control device executes a feedback control by detecting voltage and current applied to a compressor motor and estimating a stroke in a sensor-less manner. In this instance, the compressor control device includes a triac or an inverter that controls the compressor.

The linear compressor performing the feedback control can detect a top dead center (TDC) of the piston only after the piston collides with a discharge valve provided on a discharge unit or device of the cylinder, thereby generating noise due to the collision between the piston and the discharge valve. That is, when the piston collides with the discharge valve in the general linear compressor, a stroke estimation is executed to determine that the piston reaches the TDC of the cylinder. Accordingly, collision noise between the piston and the discharge valve is inevitable.

BRIEF DESCRIPTION OF THE DRAWINGS

Embodiments will be described in detail with reference to the following drawings in which like reference numerals refer to like elements, and wherein.

DETAILED DESCRIPTION

Hereinafter, description will be given in detail of embodiments disclosed herein with reference to the accompanying drawings. It should be noted that technological terms used herein are merely used to describe embodiments, but not to limit the embodiments. Also, unless particularly defined otherwise, technological terms used herein should be construed as a meaning that is generally understood by those having ordinary skill in the art to which the invention pertains, and should not be construed too broadly or too narrowly. Further, if technological terms used herein are wrong terms unable to correctly express the spirit, then they should be replaced by technological terms that are properly understood by those skilled in the art. In addition, general terms used should be construed based on the definition of dictionary, or the context, and should not be construed too broadly or too narrowly.

Figure 1A:
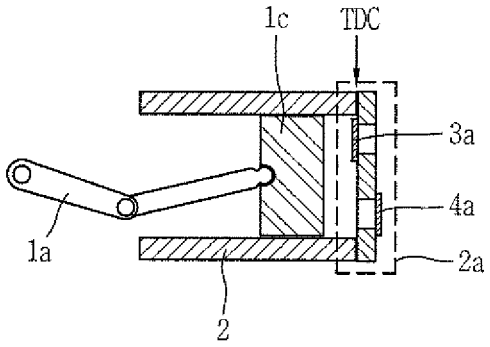
FIG. 1A RELATED ART
FIG. 1A is a conceptual view illustrating one example of a related art recipro type reciprocating compressor.

FIG. 1A illustrates one example of a related art recipro type reciprocating compressor. As aforementioned, a motor installed in the recipro type reciprocating compressor may be coupled to a crankshaft 1*a*, so as to convert a rotary motion of the motor into a linear reciprocating motion.

As illustrated in FIG. 1A, a piston disposed in the recipro type reciprocating compressor may perform a linear reciprocating motion within a preset or predetermined position range according to a specification of the crankshaft or a specification of a connecting rod connecting the piston to the crankshaft.

Therefore, for designing the recipro type compressor, when the specifications of the crankshaft and the connecting rod are decided within a range of a TDC, piston 1*c* does not collide with a discharge unit or device 2*a* disposed or provided on or at one end of the cylinder 2, even without applying a separate motor control algorithm.

In this instance, the discharge unit 2*a* disposed or provided in the recipro type compressor may be fixed to the cylinder 2. For example, the discharge unit 2*a* may include a suction valve 3*a*, a discharge valve 4*a*, and a valve plate. That is, as illustrated in FIG. 1A, the discharge unit 2*a* may be formed in a shape of a valve plate which is fixed to one end of the cylinder 2, and the valve plate may be provided with the suction valve 3*a* to suction a refrigerant into the cylinder 2, and the discharge valve 4*a* that discharges a compressed refrigerant.

However, unlike a linear type compressor to be explained later, the recipro type compressor generates friction among the crankshaft, the connecting rod, and the piston, and thus, has more factors generating the friction than the linear type compressor.

Figure 1B:
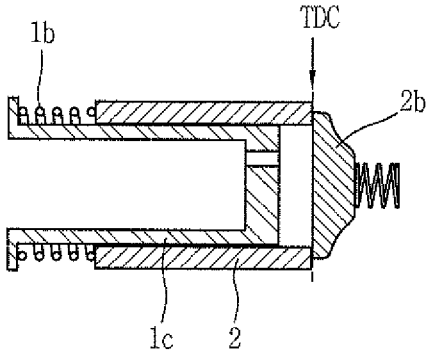
FIG. 1B RELATED ART
FIG. 1B is a conceptual view illustrating one example of a related art linear type reciprocating compressor.

FIG. 1B illustrates one example of a related art linear type reciprocating compressor. Comparing FIGS. 1A and 1B, unlike the recipro type of which implements the linear motion by the motor connected with the crankshaft and the connecting rod, the linear type compressor reciprocates a piston 1*c* using a linear motion of a linearly-moving motor by connecting the piston 1*c* to a mover of the motor. As illustrated in FIG. 1B, an elastic member 1*b* may be connected between a cylinder 2 and a piston 1*c* of a linear type compressor. The piston 1*c* may perform a linear reciprocating motor by a linear motor. A controller of the linear compressor may control the linear motor to switch a moving direction of the piston 1*c*.

The controller of the linear compressor illustrated in FIG. 1B may determine a time point at which the piston 1*c* collides with a discharge unit or device 2*b* as a time point at which the piston 1*c* reaches the TDC, and accordingly, control the linear motor for converting the moving direction of the piston 1*c*.

The discharge unit 2*b* illustrated in FIG. 1B, unlike the discharge unit 2*a* illustrated in FIG. 1A, is connected to the elastic member 1*b* and is not fixed to one end of the cylinder.

Figure 2A:
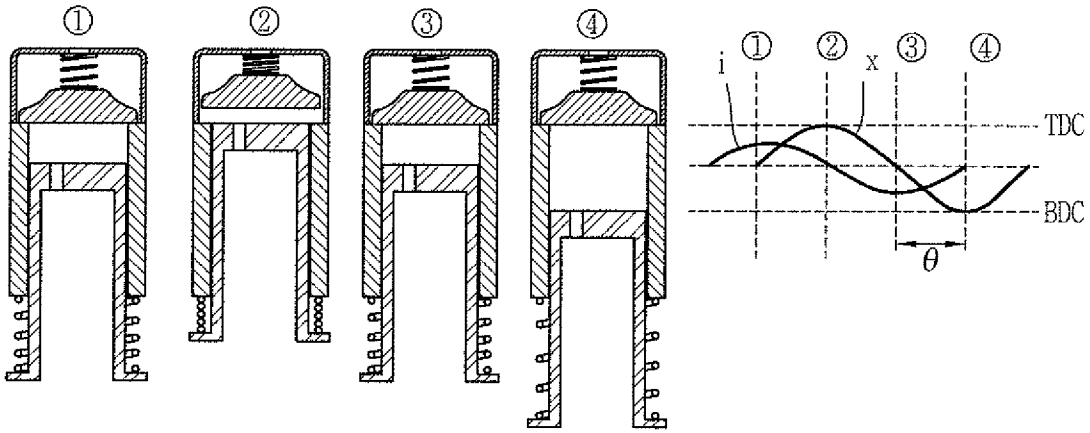
FIG. 2A RELATED ART
FIG. 2A is a conceptual view illustrating one embodiment related to a top dead center (TDC) control of a related art compressor.

Hereinafter, FIG. 2A illustrates one embodiment related to a TDC control of a compressor for preventing collision between the piston 1*c* and the discharge unit 2*b*. Also, FIGS. 2B and 2C show graphs of parameters associated with the motion of the piston.

As illustrated in FIG. 2A, the piston 1*c* may reciprocate in the order of ① to ④ within the cylinder 2 on the time basis. Referring to ② of FIG. 2A, when the piston 1*c* reaches the TDC during the reciprocating motion, collision may be caused between the piston 1*c* and the discharge unit 2*b*. In response to the collision, the elastic member 1*b* connected to the discharge unit 2*b* may be compressed such that the discharge unit 2*b* may be temporarily spaced apart from one end of the cylinder 2.

Figure 2B:
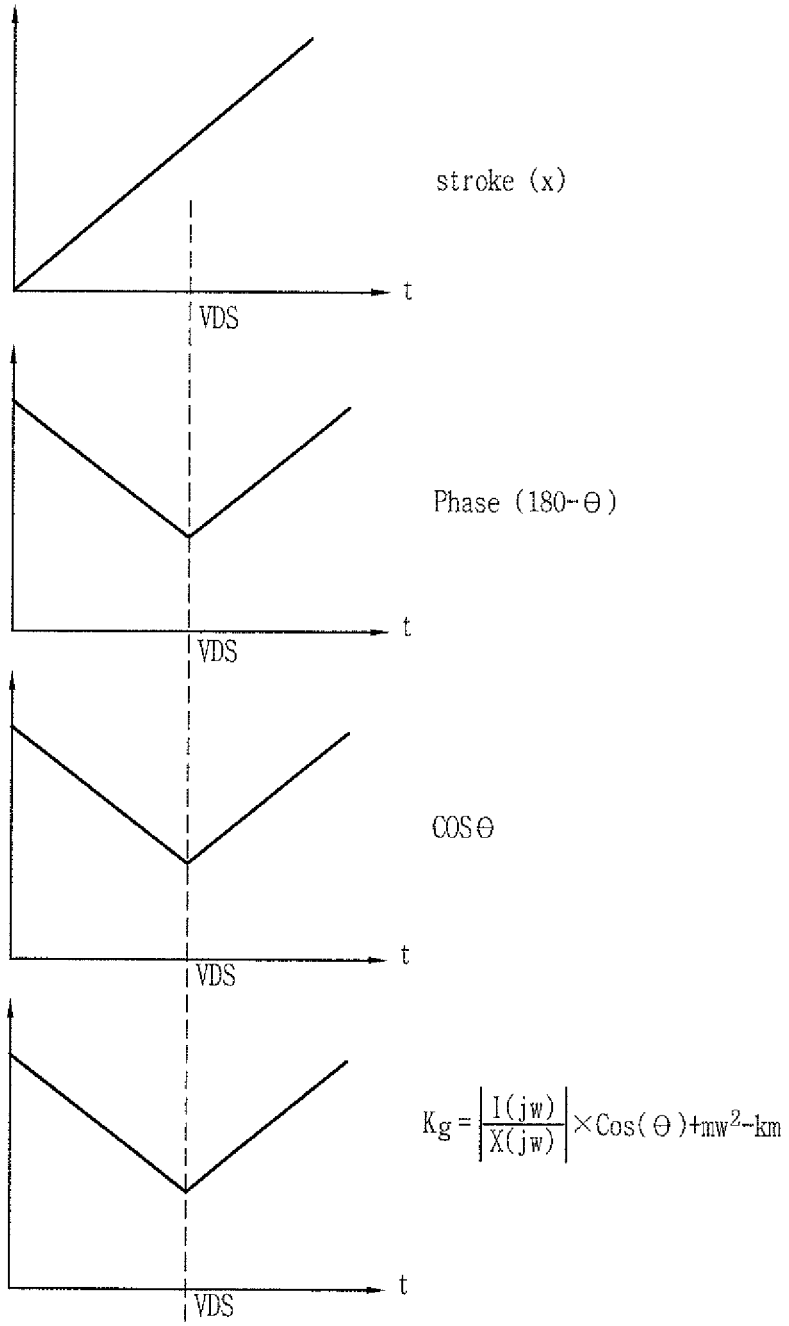
FIG. 2B RELATED ART
FIG. 2B is a graph showing various parameters used in the TDC control of the related art compressor.
Figure 2C:
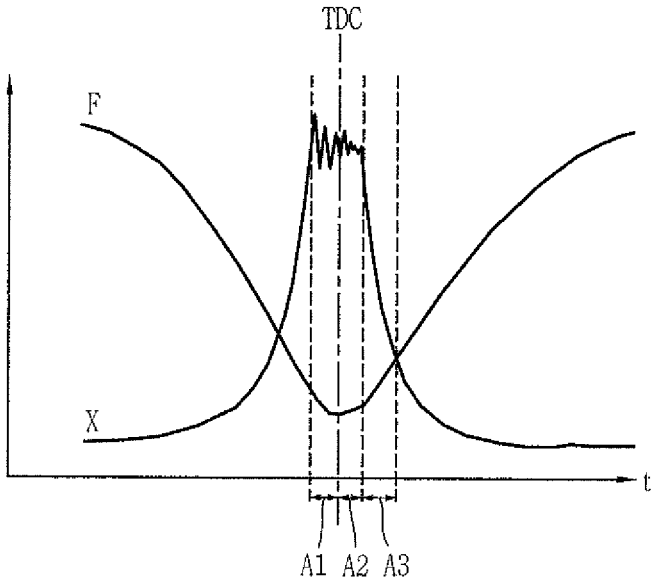
FIG. 2C RELATED ART
FIG. 2C is a graph showing a relationship between a stroke of the related art compressor and a load applied to a piston.

Referring to FIG. 2B together with FIG. 2A, the graphs in relation to the general linear compressor are shown. As illustrated in FIG. 2B, a phase difference θ between a motor voltage or motor current and a stroke x of the piston may form an inflection point at a time point at which the piston reaches the TDC.

Also, a value obtained by subtracting the phase difference θ from 180° may form the inflection point at the time point at which the piston reaches the TDC. A cosine value cos θ of the phase difference may form the inflection point at the time point at which the piston reaches the TDC. In addition, even a gas constant Kg as a variable related to the reciprocating motion of the piston may form the inflection point at the time point at which the piston reaches the TDC. An embodiment for calculating the gas constant Kg will be described later with reference to Equation 2.

Referring to FIG. 2C, a graph showing a load F that changes according to the stroke x of the piston illustrated in FIG. 2A is shown. The load F is defined as pressure or force applied to the piston for one cycle.

As illustrated in FIG. 2C, a dead volume may be reduced in response to an increase in the stroke x within an area A1 where the piston moves close to the TDC. The area A1 is defined as an under-stroke area.

In an area A3 where the piston moves over the TDC, an entire load area may increase in response to the increase in the stroke x. The area A3 is defined as an over-stroke area.

The controller of the related art linear compressor may detect a motor current using a current sensor, detect a motor voltage using a voltage sensor, and estimate a stroke x based on the detected motor current or motor voltage. Accordingly, the controller may calculate the phase difference θ between the motor voltage or motor current and the stroke x. When the phase difference θ generates (forms) an inflection point, the controller may determine that the piston reaches the TDC, and thus, control the linear motor such that a moving direction of the piston is switched. Hereinafter, the operation that the controller of the linear compressor controls the motor such that the piston does not move over the TDC to prevent the collision between the piston and the discharge unit disposed on one end of the cylinder is referred to as "related art TDC control."

When the related art TDC control of the linear compressor illustrated in FIGS. 2A to 2C is executed, the collision between the piston and the discharge unit is inevitable. This collision brings about noise generation.

Also, as illustrated in FIG. 1B, the related art linear compressor executing the related art TDC control may be provided with the discharge unit 2*b* having the elastic member 1*b*. That is, as the related art TDC control inevitably causes the collision between the piston 1*c* and the discharge unit 2*b*, the elastic member 1*b* connected to one portion of the discharge unit 2*b* is provided. The discharge unit 2*b* is heavier and more expensive than the discharge unit 2*a* included in the recipro compressor.

To solve those problems, a compressor according to embodiments disclosed herein may include the linear motor, and a discharge unit or device with a valve plate. In this instance, for the compressor including the discharge unit with the valve plate, the cylinder, and the valve plate may be fixedly coupled to each other, and thus, the related art TDC control cannot be applied. That is, in the related art TDC control of the compressor having the linear motor, the collision between the discharge unit and the piston is inevitably caused, like a precondition. Therefore, a TDC control method different from the related TDC control is needed for the compressor including the linear motor according to embodiments disclosed herein, in which the valve plate is fixed to one end of the cylinder.

The compressor according to embodiments disclosed herein may include a pressure changing unit or device that changes a variation rate of pressure applied to the piston before the piston reaches a virtual discharge surface (VDS) during a reciprocating motion, to prevent the piston from colliding with the discharge unit. Also, the controller of the linear compressor may detect a time point at which the pressure applied to the piston or the variation rate of the pressure changes, and control the linear motor to prevent the piston from colliding with the discharge unit on the basis of the detected time point.

Figure 5A:
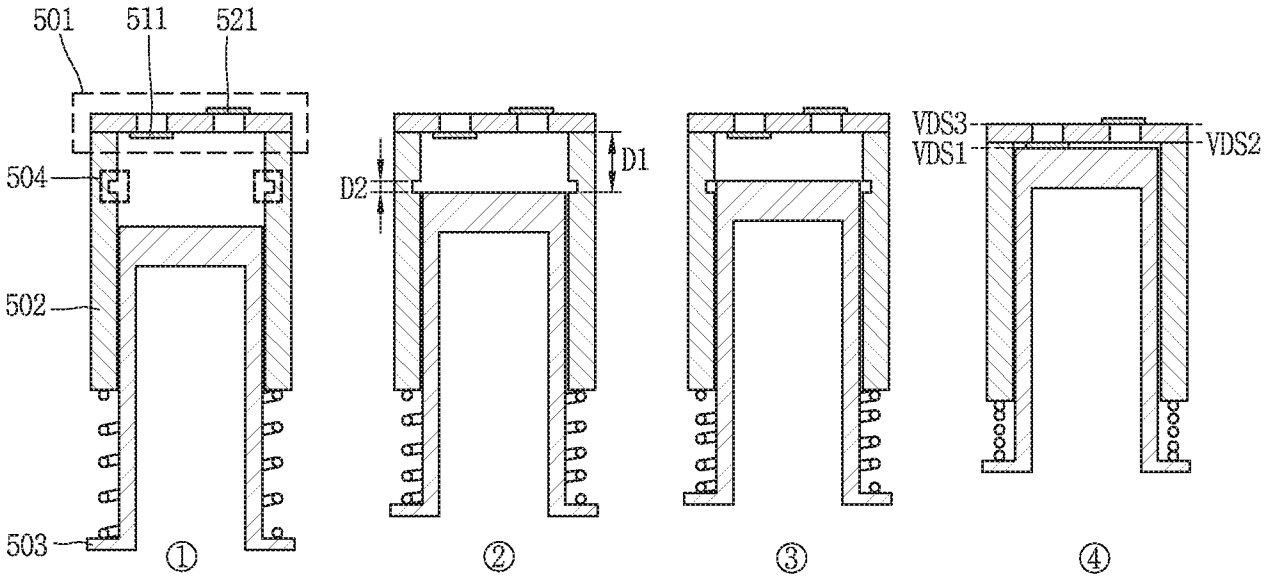
FIG. 5A is a conceptual view illustrating one embodiment related to a control of a compressor according to an embodiment.
Figure 6A:
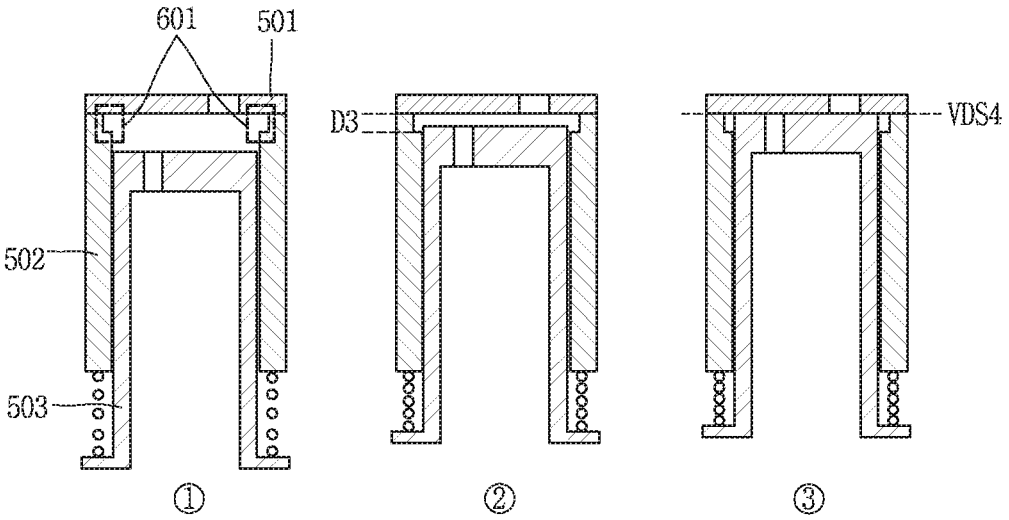
FIG. 6A is a conceptual view illustrating another embodiment related to a control of the compressor according to an embodiment.
Figure 7A:
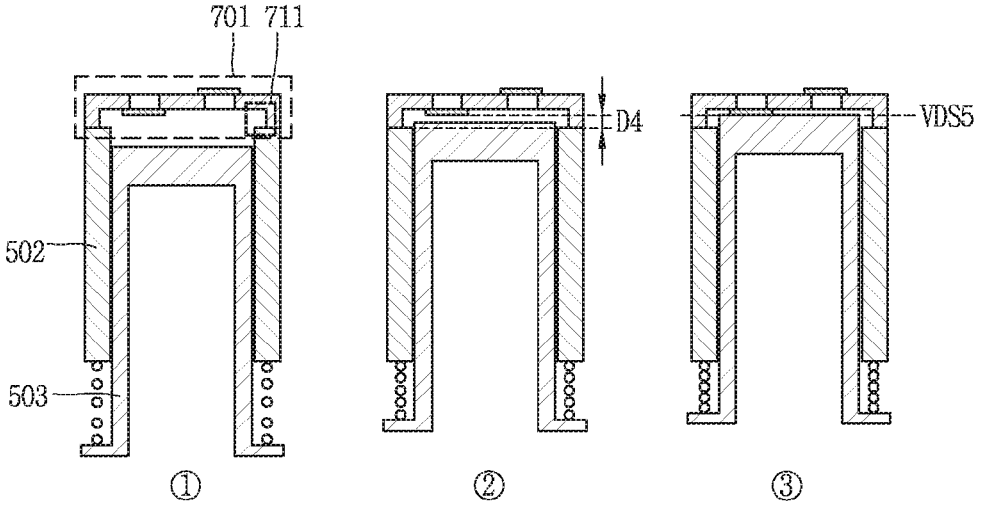
FIG. 7A is a conceptual view illustrating another embodiment related to a control of a compressor according to an embodiment.

The "VDS" may be defined as a surface brought into contact with at least a portion of the discharge unit. That is, as illustrated in FIGS. 5A, 6A, and 7A, the VDS may be brought into contact with at least a portion of the discharge unit that faces the cylinder.

The VDS may be formed to be brought into contact with at least a portion of the valve plate, the discharge valve, or the suction valve. In this manner, the VDS may variably be defined according to a user's design.

Another compressor according to embodiments may include a controller that calculates a stroke of the piston using a motor current, generates a parameter associated with a position of the piston using the motor current and the calculated stroke and controls the linear motor based on the generated parameter, and a changing unit that changes a variation rate of the generated parameter before the piston reaches the VDS within the cylinder during a reciprocating motion. The VDS may be formed on at least a portion of the discharge unit facing the cylinder.

Another compressor according to embodiments may include a controller that calculates a phase difference between a motor current and a stroke, and a changing unit that changes a variation rate of the calculated phase difference before the piston reaches the VDS during a reciprocating motion. Another compressor according to embodiments may include a controller that generates a preset or predetermined signal before the piston reaches the discharge unit when the piston moves close the discharge unit during a reciprocating motion, to prevent the collision between the piston and the discharge unit.

Another compressor according to embodiments may include a controller that determines whether the piston has passed through an arranged position of an additional volume unit within the cylinder using a detected motor voltage or motor current, and controls the linear motor based on the determination result. Another compressor according to embodiments may include a pressure changing unit or device that changes a pressure applied to the piston or a variation rate of the pressure before the piston reaches the valve plate during a reciprocating motion. Also, a controller of the linear compressor according to embodiments may detect a time point at which a pressure or a variation rate of the pressure changes, and control the piston not to collide with the valve plate based on the detected time point.

In the related art TDC control, a time point at which a variable associated with the phase difference between the motor current and the stroke of the piston forms the inflection point is detected, and determines whether the piston reaches the TDC. However, it is difficult to detect the change in the pressure applied to the piston or the variation rate of the pressure, which is generated by the pressure changing unit, merely using the variable associated with the phase difference. Therefore, the controller of the linear compressor according to embodiments may generate a new parameter by applying a motor current and motor voltage detected in real time to a preset or predetermined transformation equation, in order to determine whether the pressure applied to the piston or predetermined or the variation rate of the pressure has been changed by the pressure changing unit.

Figure 3A:
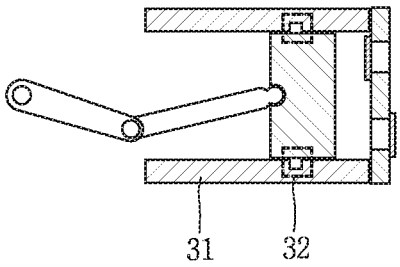
FIGS. 3A and 3B are conceptual views illustrating an embodiment related to a groove formed on an inner wall of a cylinder in a reciprocating compressor according to an embodiment.
Figure 3B:
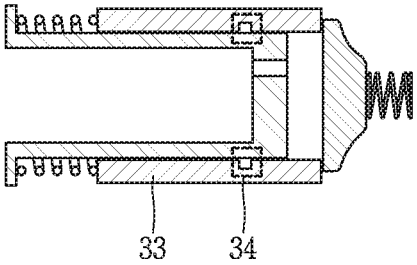

FIGS. 3A and 3B illustrate embodiments each related to a groove provided on an inner wall of the cylinder of the reciprocating compressor. The compressor of FIGS. 3A and 3B is provided with a groove on an inner wall of a cylinder for the purpose of reducing friction between the piston and the inner wall of the cylinder. Referring to FIG. 3A, a groove 32 may be provided on an inner wall of a cylinder 31 included in a recipro type compressor. Referring to FIG. 3B, a groove 34 may be provided on an inner wall of a cylinder 33 included in a linear compressor.

As such, the grooves 32 and 34 provided in the cylinders of the compressors of FIGS. 3A and 3B reduce abrasion due to friction generated between the inner wall of the cylinder and the piston and allow abraded particles of the cylinder and the piston to be discharged out of the cylinder without being piling within the cylinder.

However, the groove formed on the inner wall of the cylinder for improving reliability of the compressor is designed without taking into account a dead volume of a compression space within the cylinder, which causes difficulty in maintaining performance of the compressor. Also, the reciprocating motion of the piston is executed without considering a spaced distance between one end of the cylinder on which the discharge unit is provided and the groove, thereby failing to prevent the collision between the discharge unit and the piston.

Therefore, to prevent the collision between the piston and the discharge unit, a compressor control to be explained in the following description, namely, a method for controlling a compressor capable of detecting a time point at which the piston passes through the groove is required.

Hereinafter, embodiments for solving those problems and thusly-obtained effects will be described.

Hereinafter, description will be given with reference to FIG. 2D which illustrates one embodiment related to components of a compressor according to an embodiment.

Figure 2D:
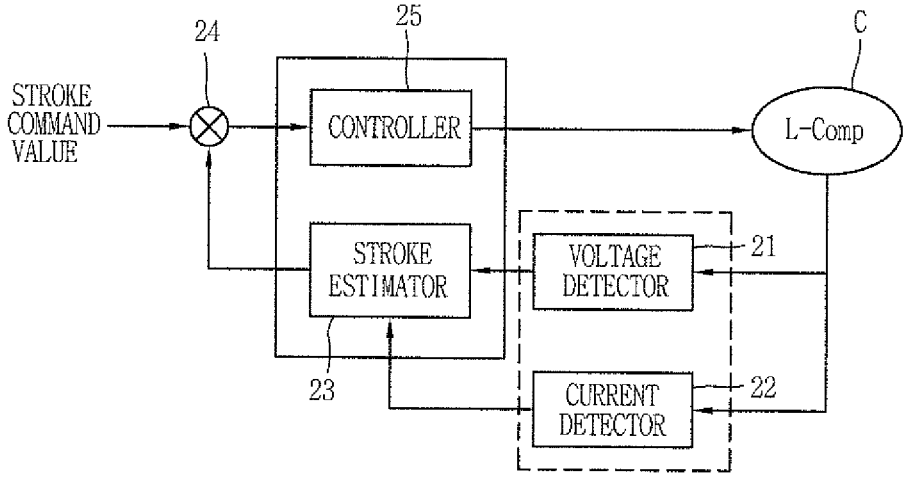
FIG. 2D is a block diagram of components of a compressor according to an embodiment.

FIG. 2D is a block diagram of a control device for a reciprocating compressor in accordance with an embodiment. As illustrated in FIG. 2D, a control device for a reciprocating compressor according to an embodiment may include a sensing unit or sensor that detects a motor current and a motor voltage associated with a motor.

As illustrated in FIG. 2D, the sensing unit may include a voltage detector 21 that detects a motor voltage applied to the motor, and a current detector 22 that detects a motor current applied to the motor. The voltage detector 21 and the current detector 22 may transfer information related to the detected motor voltage and motor current to a controller 25 or a stroke estimator 23.

In addition, referring to FIG. 2D, the compressor or the control device for the compressor according to embodiment may include the stroke estimator 23 that estimates a stroke based on the detected motor current and motor voltage and a motor parameter, a comparer 24 that compares the stroke estimation value with a stroke command value and outputs a difference in the values according to the comparison result, and the controller 25 that controls the stroke by varying the voltage applied to the motor.

The components of the control device illustrated in FIG. 2D are not essential, and greater or fewer components may implement the control device for the compressor. Further, the control device for the compressor according to this embodiment may also be applied to a reciprocating compressor, but this specification will be described based on a linear compressor.

Hereinafter, each component will be described.

The voltage detector 21 may detect the motor voltage applied to the motor. According to one embodiment, the voltage detector 21 may include a rectifying portion and a DC link portion. The rectifying portion may output a DC voltage by rectifying AC power having a predetermined size of voltage, and the DC link portion 12 may include two capacitors.

The current detector 22 may detect the motor current applied to the motor. According to one embodiment, the current detector 22 may detect a current flowing on a coil of the compressor motor.

The stroke estimator 23 may calculate a stroke estimation value using the detected motor current and motor voltage and the motor parameter, and apply the calculated stroke estimation value to the comparer 24. In this instance, the stroke estimator 23 may calculate the stroke estimation value using the following Equation 1, for example.

$$x(t) = \frac{1}{\alpha}\left[\int\left(V_M - R_{ac}i - L\frac{di}{dt}\right)dt\right] \quad \text{[Equation 1]}$$

Where, x denotes a stroke, $\alpha$ denotes a motor constant or counter electromotive force, $V_M$ denotes a motor voltage, i denotes a motor current, R denotes resistance, and L denotes inductance.

Accordingly, the comparer 24 may compare the stroke estimation value with the stroke command value and apply a difference signal of the values to the controller 25. The controller 25 may thus control the stroke by varying the voltage applied to the motor. That is, the controller 25 may reduce the motor voltage applied to the motor when the stroke estimation value is greater than the stroke command value, while increasing the motor voltage when the stroke estimation value is smaller than the stroke command value.

Figure 4A:
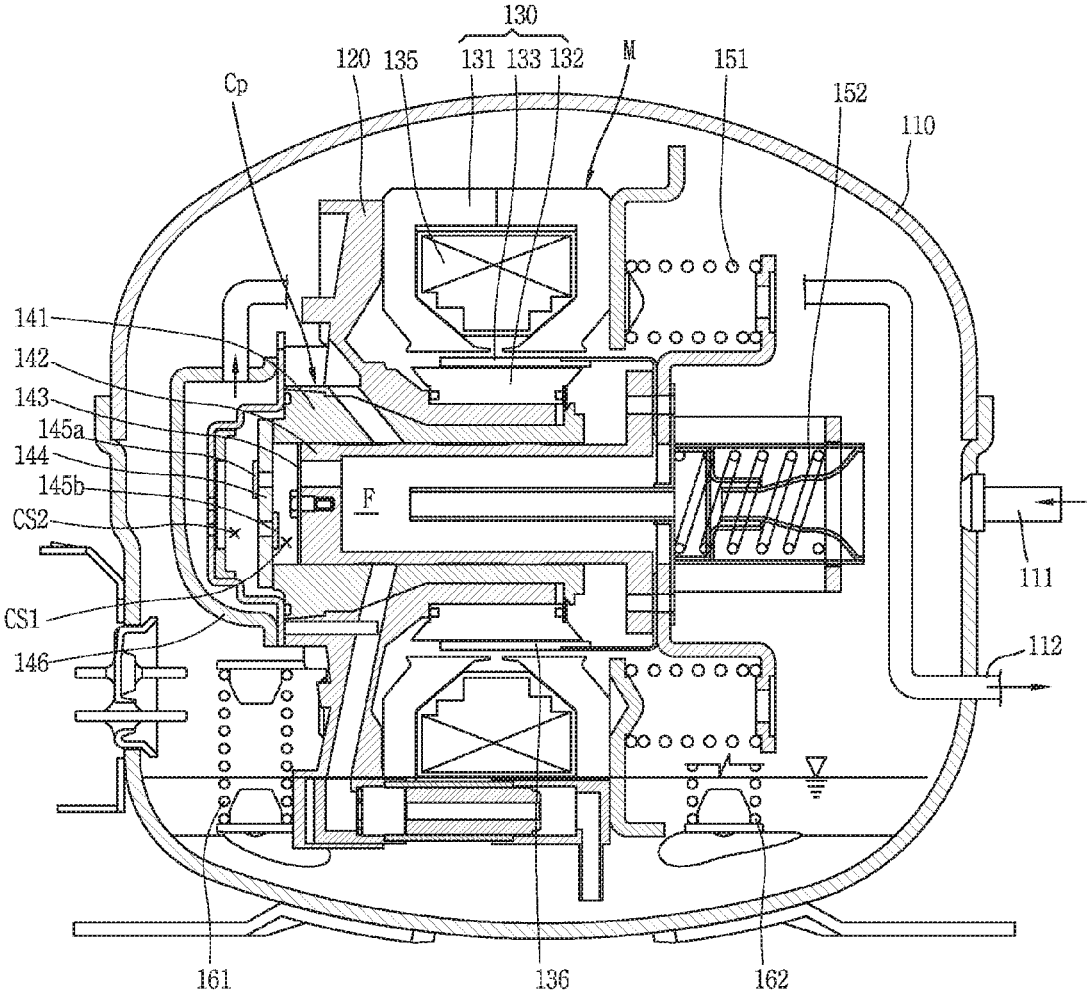
FIG. 4A is a sectional view of a compressor having a discharge unit or device having a valve plate in accordance with an embodiment.
Figure 4B:
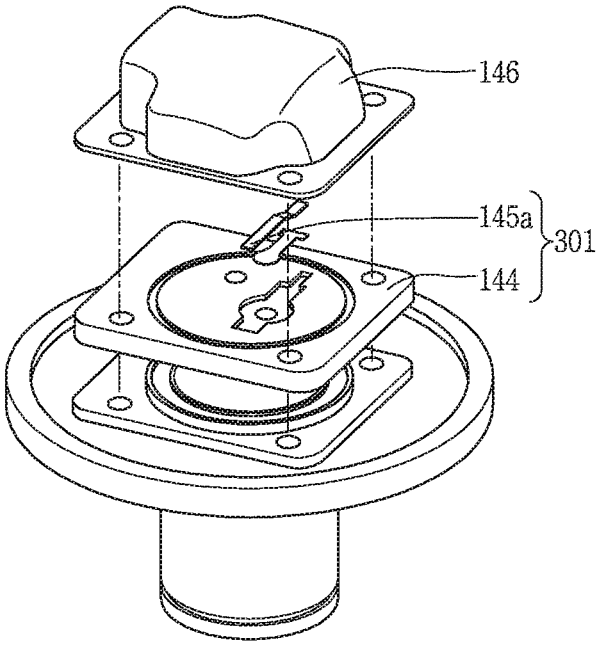
FIG. 4B is a conceptual view illustrating components of the discharge unit or device of the compressor according to an embodiment.

As illustrated in FIG. 2D, the controller 25 and the stroke estimator 23 may be configured as a single unit or component. That is, the controller 25 and the stroke estimator 23 may correspond to a single processor or computer. FIGS. 4A and 4B illustrate physical components of the compressor according to an embodiment, as well as the control device for the compressor.

FIG. 4A is a sectional view of the compressor according to an embodiment. FIG. 4B is a conceptual view illustrating components of a discharge unit or device included in the compressor according to an embodiment.

This embodiment may be applied to any type or shape of linear compressor if the control device for the linear compressor or a compressor control device is applicable thereto. The linear compressor according to the embodiment illustrated in FIG. 4A is merely illustrative, and the embodiments are not be limited to this.

In general, a motor applied to a compressor may include a stator with a winding coil and a mover with a magnet. The mover may perform a rotary motion or reciprocating motion according to interaction between the winding coil and the magnet.

The winding coil may be configured in various forms according to a type of motor. For example, the winding coil of a rotary motor may be wound on a plurality of slots, which may be formed on an inner circumferential surface of a stator in a circumferential direction, in a concentrated or distributed manner. For a reciprocating motor, the winding coil may be formed by winding a coil into a ring shape and a plurality of core sheets may be inserted to an outer circumferential surface of the winding coil in a circumferential direction.

Specifically, for the reciprocating motor, the winding coil may be formed by winding the coil into the ring shape. Thus, the winding coil is typically formed by winding a coil on an annular bobbin made of a plastic material.

As illustrated in FIG. 4A, a reciprocating compressor may include a frame 120 disposed or provided in an inner space of a hermetic shell 110 and elastically supported by a plurality of supporting springs 161 and 162. A suction pipe 111, which may be connected to an evaporator (not illustrated) of a refrigerating cycle, may be installed to communicate with the inner space of the shell 110, and a discharge pipe 112, which may be connected to a condenser (not illustrated) of the refrigerating cycle, may be disposed at one side of the suction pipe 111 to communicate with the inner space of the shell 110.

An outer stator 131 and an inner stator 132 of a reciprocating motor 130 which constitutes a motor unit or motor M are fixed to the frame 120, and a mover 133 which performs a reciprocating motion may be interposed between the outer stator 131 and the inner stator 132. A piston 142 constituting a compression unit or device Cp together with a cylinder 141 to be explained later may be coupled to the mover 133 of the reciprocating motor 130.

The cylinder 141 may be disposed or provided in a range overlapping the stators 131 and 132 of the reciprocating motor 130 in an axial direction. A compression space CS1 may be formed in the cylinder 141. A suction passage F, through which a refrigerant may be guided into the compression space CS1, may be formed in the piston 142. A suction valve 143 that opens and closes the suction passage may be disposed or provided on or at an end of the suction passage. A discharge valve 145*a* that opens and closes the compression space CS1 of the cylinder 141 may be disposed or provided on or at a front surface of the cylinder 141. One example of the cylinder 141 will be described with reference to FIG. 4B.

Referring to FIG. 4B, a discharge unit of a linear compressor according to an embodiment may include a valve plate 144, the discharge valve 145*a*, a suction valve 145*b*, and a discharge cover 146.

The embodiments disclosed herein provides an effect of reducing a weight of the discharge unit by about 5 kg by changing the discharge unit 2*b* (see FIG. 1B) disposed in the related art linear compressor into a valve plate structure. In addition, by reducing the weight of the discharge unit by about 62 times, noise which is generated due to a striking sound of the discharge unit of the linear compressor may be remarkably reduced.

That is, a valve assembly forming the discharge unit may include the valve plate 144 mounted to a head portion of the cylinder 141 (or one end of the cylinder 141), a suction valve 145*b* disposed or provided in or at a suction side of the valve plate 144 that opens and closes a suction port and the discharge valve 145*a* formed in a cantilever shape and disposed or provided in or at a discharge side of the valve plate 144 that opens and closes a discharge port.

FIG. 4B illustrates an embodiment with one discharge valve 145*a*, but the embodiments are not be limited to this. A plurality of the discharge valve 145*a* may be provided. In addition, the discharge valve 145*a* may alternatively have a cross shape, other than the cantilever shape.

A plurality of resonant springs 151 and 152 which induce a resonance motion of the piston 142 may be disposed or provided on both sides of the piston 142 in a moving direction thereof, respectively.

In the drawing, unexplained reference numeral 135 denotes a winding coil, 136 denotes a magnet, and CS2 denotes a discharge space.

In the related art reciprocating compressor, when power is applied to the coil 135 of the reciprocating motor 130, the mover 133 of the reciprocating motor 130 performs a reciprocating motion. The piston 142 coupled to the mover 133 then performs the reciprocating motion at a fast speed within the cylinder 141. During the reciprocating motion of the piston 142, a refrigerant is introduced into the inner space of the shell 110 through the suction pipe 111. The refrigerant introduced into the inner space of the shell 110 then flows into the compression space CS1 of the cylinder 141 along the suction passage of the piston 142. When the piston 142 moves forward, the refrigerant is discharged out of the compression space CS1 and then flows toward the condenser of the refrigerating cycle through the discharge pipe 112. This series of processes are repeatedly performed.

The outer stator 131 is formed by radially stacking a plurality of thin half stator cores, each of which may be formed in a shape like '⊏' to be symmetrical in a left and right direction, at both left and right sides of the winding coil 135.

Figure 5B:
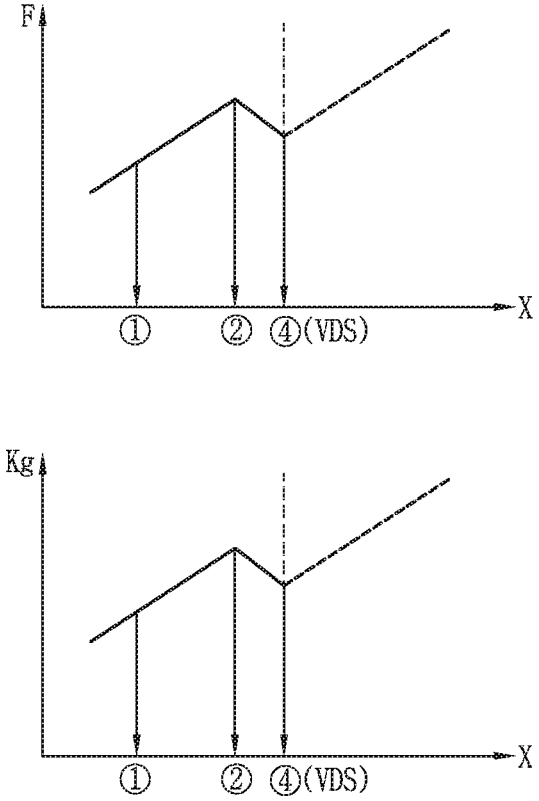
FIGS. 5B and 5C are graphs showing changes in various parameters used for controlling a compressor according to the embodiment illustrated in FIG. 5A.
Figure 5C:
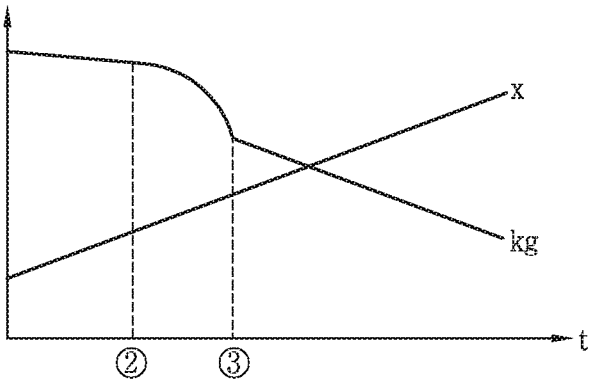

FIG. 5A illustrates one embodiment related to a compressor according to an embodiment. In addition, FIGS. 5B and 5C are graphs showing changes in various parameters used for a TDC control according to the TDC control illustrated in FIG. 5A.

As illustrated in FIG. 5A, a compressor according to an embodiment may include a piston 503 that performs a reciprocating motion within a cylinder 502, and a discharge unit or device 501 disposed or provided on or at one end of the cylinder 502 to adjust a discharge of a refrigerant compressed in the cylinder 502.

The discharge unit 501 included in the compressor according to this embodiment may be provided with a valve plate. The valve plate may be fixed to one end of the cylinder 502. At least one opening through which fluid compressed in the cylinder 503 may flow may be formed through the valve plate. In addition, the valve plate may be provided with a suction valve 511 and a discharge valve 521.

That is, the discharge unit 501 of the compressor according to this embodiment illustrated in FIG. 5A, unlike the discharge unit 2*b* of the related art linear compressor illustrated in FIG. 1B, may be configured as the valve plate. A discharge unit in a shape of a valve plate which is used in the related art recipro compressor is lighter than the discharge unit illustrated in FIG. 1B and requires less fabricating costs than the discharge unit illustrated in FIG. 1B. The discharge unit of the linear compressor illustrated in FIG. 1B is configured in a PEK valve structure, whereas the discharge unit of the linear compressor according to an embodiment is configured as a valve plate so as to provide an effect of reducing fabricating costs of the compressor. More concretely, the valve plate structure may reduce costs by about 1000 Korean Won per one discharge unit, compared with the PEK valve structure.

In addition, the discharge unit configured as the valve plate is lighter in weight than the discharge unit configured as the PEK valve. Therefore, noise generated due to a striking sound (crashing sound) between the discharge unit and the cylinder when the discharge unit is closed may be reduced. This may result in reducing a thickness of a shell covering the compressor and simplifying a material of a discharge cover. That is, a noise-reducing structure, such as the shell and a muffler, may be simplified in the linear compressor according to embodiments, thereby further reducing fabricating costs in comparison the related art linear compressor.

Meanwhile, as illustrated in FIG. 5A, the discharge unit of the compressor according to embodiments may be fixed to the one end of the cylinder 502. Accordingly, when executing the related art TDC control illustrated in FIGS. 1B and 1C, stability of the linear compressor is lowered due to the collision between the piston 503 and the discharge unit.

That is, the linear compressor executing the related art TDC control has used the discharge unit having the elastic member. Thus, the linear reciprocating motion of the piston is controlled by determining the collision time point between the discharge unit and the piston as a TDC arrival time point of the piston. However, in the linear compressor according to embodiments, unlike the related art linear compressor, the discharge unit in the shape of the valve plate is fixed to the one end of the cylinder 502. Accordingly, when the related art TDC control is executed, noise may be generated due to the collision between the piston 503 and the discharge unit, operation stability of the compressor may be lowered, and abrasion of the piston 503 and the discharge unit may occur.

Therefore, this specification proposes a compressor, capable of preventing collision between a piston and a discharge unit, in the linear compressor having the discharge unit in a shape of a valve plate, and a control method thereof. Referring to FIG. 5A, the compressor according to embodiments may include a pressure changing unit or device 504 that changes a variation rate of pressure applied to the piston before the piston 503 reaches the VDS during the reciprocating motion, to prevent the piston 503 from colliding with the discharge unit. That is, the compressor according to embodiments may include the pressure changing unit 504 that changes the variation rate of the pressure applied to the piston 503 before the piston 503 reaches the valve plate during the reciprocating motion.

As illustrated in FIG. 5A, the pressure changing unit 504 may include a groove provided within the cylinder. Also, the pressure changing unit 504 may be disposed or provided at a position spaced apart from one end of the cylinder 502 having the valve plate by a predetermined distance D1.

Unlike the grooves formed in the cylinders of the related art compressors illustrated in FIGS. 3A and 3B, the pressure changing unit 504 illustrated in FIG. 5A may relevantly change the pressure applied to the piston or the variation rate of the pressure such that the controller of the compressor may detect it, before the piston reaches the VDS. In addition, the controller of the compressor according to embodiments may control the linear motor based on a distance between the pressure changing unit 504 and the VDS.

Although not illustrated in FIG. 5A, the pressure changing unit 504 may include a concave-convex portion formed within the cylinder. For example, the concave-convex portion may be connected to the elastic member. When the piston moves over the arranged position of the concave-convex portion, pressure applied to the piston or the variation rate of the pressure may change.

Although not illustrated in FIG. 5A, the pressure changing unit 504 may also include a stepped portion formed on one end of the cylinder. For example, the stepped portion may be formed on an H surface of the cylinder.

The pressure changing unit 504 illustrated in FIG. 5A has the shape of the groove, but the pressure changing unit according to embodiments are not be limited to this. The pressure changing unit according to embodiments may be implemented in any type or shape if it can change the pressure applied to the piston 503 or the variation rate of the pressure before the piston 503 reaches the VDS while the piston 503 moves toward the valve plate within the cylinder 502.

That is, the pressure applied to the piston or the variation rate of the pressure before the piston 503 moves over the pressure changing unit is different from the pressure applied to the piston or the variation rate of the pressure until before the piston reaches the VDS after moving over the pressure changing unit. In addition, the pressure changing unit 504 should be designed in a manner that a compression rate of a refrigerant or operation efficiency of the compressor cannot be substantially affected even though the pressure changing unit 504 changes the pressure applied to the piston or the variation rate of the pressure at a specific time point during the reciprocating motion of the piston.

Simultaneously, the pressure or the variation rate of the pressure changed by the pressure changing unit 504 should be high enough to be detected by the controller of the compressor. That is, the controller of the compressor may detect a time point at which the piston passes through the arranged position of the pressure changing unit 504 within the cylinder or a time point at which the pressure changing unit 504 changes the pressure applied to the piston or the pressure variation rate.

Referring to FIG. 5A, the piston 503 of the compressor according to embodiments may perform the reciprocating motion in the order of ① to ④, in response to the linear motor being driven within the cylinder 502. The piston 503 may move close to the TDC from a bottom dead center (BDC) ①. In this instance, a variation rate of pressure applied to the piston 503 may be maintained.

When the piston 503 is brought into contact with the pressure changing unit 504 ②, the controller may determine that the pressure applied to the piston or the pressure variation rate changes. Also, when the piston 503 passes through the pressure changing unit 504 ③, the controller may determine that the pressure applied to the piston or the pressure variation rate changes.

In one embodiment, when the piston 503 is brought into contact with the discharge unit 501 ④, the controller may control the linear motor to switch the moving direction of the piston. In another embodiment, the controller may control the linear motor to switch the moving direction of the piston before the piston 503 is brought into contact with the discharge unit 501. In another embodiment, the controller may control the linear motor to switch the moving direction of the piston before the piston 503 reaches the VDS. Accordingly, the compressor according to embodiments may prevent the collision between the piston 503 and the discharge unit 501.

The VDS may be defined by the discharge unit 501 and the cylinder 502. That is, the VDS may be formed on at least a part of the discharge unit 501 facing the cylinder 502.

A first VDS VDS1 may be formed on a surface of the discharge unit 501 which is brought into contact with a portion of the suction valve 511. In this instance, the portion of the suction valve 511 may be a portion located in the cylinder 502.

A second VDS VDS2 may be formed on a surface where one surface of the valve plate of the discharge unit 501 and one end of the cylinder are brought into contact with each other. In addition, a third VDS VDS3 may also be formed on another surface of the valve plate of the discharge unit 501.

The controller may control the linear motor such that the piston 503 does not collide with the discharge unit 501, on the basis of one of the first to third VDSs VDS1, VDS2, and VDS3, according to a user setting.

A compressor according to one embodiment may include a controller that calculates a stroke of a piston using a motor current, generates a parameter associated with a position of the piston using the motor current and the calculated parameter, and controls a linear motor based on the generated parameter. In addition, the compressor may include a changing unit or device that changes a variation rate of the generated parameter before the piston reaches the VDS within a cylinder during a reciprocating motion.

Also, a compressor according to another embodiment may include a controller that calculates a phase difference between the motor current and the calculated stroke, and controls the linear motor based on the calculated phase difference. The controller may further include a changing unit or device that changes a variation rate of the calculated phase difference before the piston reaches the VDS during the reciprocating motion. The changing unit may be different from or the same as the pressure changing unit 504.

A controller of the compressor according to another embodiment may generate a preset or predetermined signal before the piston reaches the discharge unit when the piston moves close to the discharge unit or device during the reciprocating motion, in order to prevent collision between the piston and the discharge unit. In this instance, the controller may generate the preset signal using the detected motor voltage and motor current.

Also, the controller may determine that the piston is spaced apart from the discharge unit by a preset or predetermined distance while the piston moves close to the discharge unit, on the basis of a generation time point of the preset signal. Therefore, the controller may control the linear motor to switch a moving direction of the piston after a preset or predetermined time interval elapses from the generation time point of the preset signal.

A compressor according to another embodiment may include an additional volume unit or device disposed or provided within the cylinder to prevent the collision between the piston and the discharge unit. In this instance, the controller may determine whether the piston has passed through an arranged position of the additional volume unit within the cylinder, and control the linear motor based on the determination result.

Referring to FIG. 5A, the compression space of the cylinder may include a first volume formed by the discharge unit and a surface brought into contact with at least a portion of the inner wall of the cylinder, and a second volume formed by the additional volume unit. The additional volume unit may change a load applied to the piston when the piston passes through an arranged position of the additional volume unit within the cylinder during the reciprocating motion. Therefore, the controller may control the linear motor to switch the moving direction of the piston after a preset or predetermined time interval elapses from the time point at which the piston passes through the arranged position of the additional volume unit within the cylinder. In one example, the additional volume unit may be defined by a groove included in the pressure changing unit 504.

FIG. 5B shows graphs showing a load F and a gas constant Kg that change as the piston illustrated in FIG. 5A performs the reciprocating motion in the order of ① to ④. As illustrated in FIG. 5B, the controller may calculate a stroke of the piston based on a motor current and a motor voltage. The controller may generate a parameter associated with a movement or position of the piston using the motor current, the motor voltage, and the calculated stroke. In addition, the controller may control the linear motor based on the generated parameter.

In this instance, the compressor according to embodiments may include a changing unit or device (not illustrated) that changes a variation rate of the generated parameter before the piston reaches the VDS within the cylinder during the reciprocating motion. That is, the changing unit may change the variation rate of the generated parameter before the piston reaches the VDS during the reciprocating motion.

In addition, the parameter may include at least one of pressure applied to the piston, a variable associated with a phase difference between the motor current and the stroke, a variable associated with a phase difference between the motor voltage and the stroke, or a gas constant Kg associated with the reciprocating motion of the piston. That is, the controller may detect the load F or the gas constant Kg, and detect the change in the variation rate of the load F or the gas constant Kg before the piston reaches the VDS.

In addition, the controller may detect a time point at which the variation rate of the parameter changes, and control the linear motor based on the detected time point such that the piston cannot reach or move over the VDS. When the piston 503 is brought into contact with the pressure changing unit 504 ②, the controller may detect the change in the variation rate of the load F or the gas constant Kg. In this instance, the load F is defined as pressure or force applied to the piston for each cycle.

Although not illustrated in FIG. 5B, when the piston 503 is brought into contact with the pressure changing unit 504 ②, the controller may detect the change in the variation rate of the variable associated with the phase difference between the current and the stroke or the variable associated with the phase difference between the voltage and the stroke. For example, the variable associated with the phase difference θ may include a value, which is obtained by subtracting the phase difference θ from 180°, or a cosine value Cos θ (see FIG. 2B).

FIG. 5C is a graph showing changes in the stroke x and the gas constant Kg on a time (t) basis. As illustrated in FIG. 5C, the change in the gas constant Kg when the piston 503 is brought into contact with the pressure changing unit 504 ② may be greater than the change in the gas constant Kg when the piston passes through the pressure changing unit 504 ③. In addition, at a time point at which the piston 503 passes through a first position corresponding to one end of the pressure changing unit 504 or a second position corresponding to another end of the pressure changing unit 504, the controller may determine that the pressure applied to the piston or the variation rate of the pressure changes.

In one embodiment, the controller may detect a time point at which a variation rate of pressure applied to the piston changes, and control the linear motor to prevent the piston from reaching the VDS based on the detected time point. The controller may control the linear motor to switch a moving direction of the piston at a time point at which the variation rate of the pressure applied to the piston changes, or control the linear motor to switch the moving direction of the piston after a preset or predetermined time interval elapses from the detected time point.

The controller may calculate a stroke of the piston in real time, and detect a time point at which a variation rate of the pressure applied to the piston changes based on the calculated stroke. In this instance, the controller may determine that a time point at which a variation rate of the calculated stroke changes more than a preset or predetermined value corresponds to the time point at which the variation rate of the pressure applied to the piston changes.

Also, the controller may calculate a phase difference between the stroke of the piston and the motor current in real time, and detect a time point that the variation rate of the pressure applied to the piston changes based on the In the calculated phase difference. In this instance, the controller may determine that a time point at which a variation rate of the calculated phase difference changes more than a preset or predetermined value corresponds to the time point at which the variation rate of the pressure applied to the piston changes.

Also, the controller may calculate a phase difference between the stroke of the piston and the motor voltage in real time, and detect a time point at which the variation rate of the pressure applied to the piston changes based on the calculated phase difference. In this instance, the controller may determine that the a time point at which variation rate of the calculated phase difference changes more than a preset or predetermined value corresponds to the time point at which the variation rate of the pressure applied to the piston changes.

The preset value may change according to an output of the linear motor. For example, when the output of the motor increases, the controller may reset the preset value to a smaller value.

Although not illustrated, the linear compressor according to embodiments may further include an input unit or input that receives a user input associated with the preset time interval. The controller may reset the time interval based on the user input applied.

The controller may determine whether the piston has moved over the VDS on the basis of information related to the motor current, the motor voltage, and the stroke. In this instance, when it is determined that the piston has moved over the VDS, the controller may change the preset time interval. For example, the controller may reduce the preset time interval when it is determined that the piston has moved over the VDS.

The controller may determine whether the collision between the piston and the valve plate has occurred on the basis of information related to the motor current, the motor voltage, and the stroke. In this instance, the controller may change the preset time interval when it is determined that the collision between the piston and the valve plate has occurred. For example, the controller may reduce the preset time interval when it is determined that the piston has moved over the VDS.

In addition, the linear compressor according to embodiments may include a memory that stores information related to changes in the motor current, the motor voltage, and the stroke during the reciprocating motion of the piston. The memory may store information related to the changes for a time interval within which a reciprocating period of the piston is repeated by a predetermined number of times.

Accordingly, the controller may determine whether the piston collides with the valve plate using the information related to the change history of the motor voltage, the motor current, and the stroke.

The controller may calculate the stroke of the piston in real time, and detect the time point at which the variation rate of the pressure applied to the piston changes based on the calculated stroke. In this instance, the controller may determine that the time point at which the variation rate of the calculated stroke changes more than a preset or predetermined value corresponds to the time point at which the variation rate of the pressure applied to the piston changes.

Also, the controller may calculate the phase difference between the stroke and the motor current in real time and detect the time point at which the variation rate of the pressure applied to the piston changes based on the calculated phase difference. In this instance, the controller may determine that the time point at which the variation rate of the calculated phase difference changes more than a preset or predetermined value corresponds to the time point at which the variation rate of the pressure applied to the piston changes.

For example, the controller may detect a time point at which the variation rate of the phase difference is changed from a positive (+) value into a negative (−) value as the time point at which the variation rate of the pressure applied to the piston changes. As another example, the controller may detect a time point at which the variation rate of the phase difference is changed from a negative (−) value into a positive (+) value as the time point at which the variation rate of the pressure applied to the piston changes.

In one embodiment, the discharge unit 501 may be disposed or provided on or at one end of the cylinder 502. The pressure changing unit 504 may be disposed or provided between the one end of the cylinder, on which the discharge unit is disposed or provided, and another end of the cylinder. The pressure changing unit 504 may be disposed or provided between the one end of the cylinder 502 with the discharge unit 501 and a central portion of the cylinder. That is, the pressure changing unit 504 may be located adjacent to the one end at which the discharge unit is disposed or provided within the cylinder.

Figure 6B:
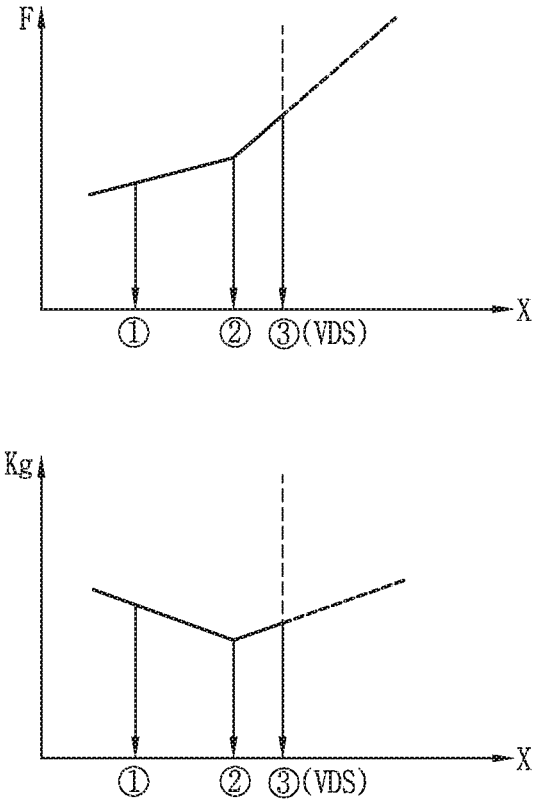
FIG. 6B is a graph showing changes in various parameters used for controlling the compressor according to the embodiment illustrated in FIG. 6A.

FIG. 6A illustrates another embodiment related to a compressor according to embodiments. FIG. 6B shows graphs showing changes in various parameters used for controlling the compressor according to the embodiment illustrated in FIG. 6A.

As illustrated in FIG. 6A, the compressor according to this embodiment may include a pressure changing unit or device 601 that changes a variation rate of pressure applied to the piston 503 before the piston 503 reaches the discharge unit 501 during the reciprocating motion.

As illustrated in FIG. 6A, the pressure changing unit 601 may include a groove formed within the cylinder. Also, the pressure changing unit 601 may be formed by the discharge unit 501 and one end of the cylinder 502.

As illustrated in FIG. 6A, the pressure changing unit 601 according to this embodiment may include a groove formed on one end of the cylinder 502. Accordingly, when the piston enters the pressure changing unit 601 during the reciprocating motion ②, the controller may detect that the pressure applied to the piston or a variation rate of the pressure changes.

Unlike the groove formed within the cylinder of the related art compressor described with reference to FIGS. 3A and 3B, the pressure changing unit 601 illustrated in FIG. 6A may relevantly change the pressure applied to the piston or the variation rate of the pressure such that the controller of the compressor may detect it, before the piston reaches the VDS. In addition, the controller of the compressor according to embodiments may control the linear motor based on a distance D3 between the pressure changing unit 601 and a fourth VDS VDS4. In this instance, the fourth VDS VDS4 may be located on a surface formed by the one end of the cylinder 502.

FIG. 6A does not illustrate the suction valve and the discharge valve of the discharge unit 501, as it is merely for helping in understanding the embodiment. Therefore, the controller of the compressor according to embodiments may control the linear motor such that the piston 503 cannot reach the first to fourth VDSs VDS1, VDS2, VDS3, and VDS4, by use of the pressure changing unit 601 provided on the one end of the cylinder having the discharge unit disposed thereon.

FIG. 6B illustrates graphs showing a load F and a gas constant Kg which change as the piston illustrated in FIG. 6A performs the reciprocating motion in the order of ① to ③. As illustrated in FIG. 6B, the controller may calculate the load F or the gas constant Kg based on the motor current or the motor voltage, and detect that a variation rate of the load F or the gas constant Kg changes before the piston reaches the VDS.

The controller may detect that the variation rate of the load F or the gas constant Kg changes when the piston 503 enters the pressure changing unit 601 before reaching the VDS ②. In one embodiment, the pressure changing unit 601 may include the groove formed by the discharge unit and the one end of the cylinder.

Figure 7B:
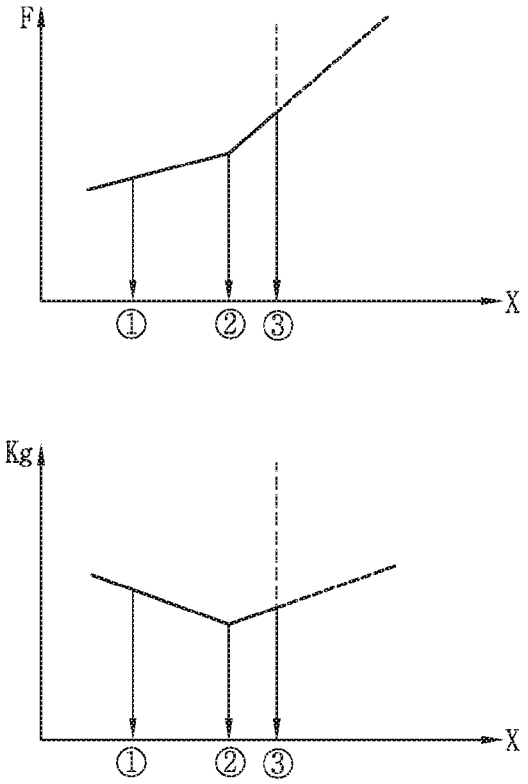
FIG. 7B is a graph showing changes in various parameters used for controlling the compressor according to the embodiment illustrated in FIG. 7A.

FIG. 7A illustrates another embodiment related to a compressor according to embodiments. FIG. 7B illustrates graphs showing changes in various parameters used for controlling the compressor according to the embodiment illustrated in FIG. 7A.

Referring to FIG. 7A, the compressor according to this embodiment may include a pressure changing unit 711 that changes a variation rate of pressure applied to the piston 503 before the piston 503 reaches a discharge unit 701 during the reciprocating motion. As illustrated in FIG. 7A, the pressure changing unit 711 may include a groove which is formed by the discharge unit 701 and one end of the cylinder 502. The pressure changing unit 711 may include a groove formed on a valve plate of the discharge unit 701 at an outside of the cylinder.

That is, referring to FIG. 7A, the pressure changing unit 711 according to this embodiment may include a groove formed by an outer circumferential surface of the one end of the cylinder 502 and the valve plate. Accordingly, the controller may detect that pressure applied to the piston or a variation rate of the pressure changes when the piston moves into the pressure changing unit 701 ② during the reciprocating motion.

The pressure changing unit 711 illustrated in FIG. 7A may relevantly change the pressure applied to the piston or the variation rate of the pressure such that the controller of the compressor may detect it, before the piston reaches the VDS. In addition, the controller of the compressor according to embodiments may control the linear motor based on a distance D4 from the one end of the cylinder to a fifth VDS VDS5. In this instance, the fifth VDS VDS5 may be located on a surface formed by one surface of a suction valve. The controller of the compressor according to embodiments may control the linear motor to prevent the piston 503 from reaching the first to fifth VDSs VDS1, VDS2, VDS3, VDS4, and VDS5, by use of the pressure changing unit 711 formed on the one end of the cylinder having the discharge unit disposed thereon.

FIG. 7B illustrates graphs showing a load F and a gas constant Kg that change as the piston performs the reciprocating motion in the order of ① to ③. As illustrated in FIG. 7B, the controller may calculate the load F or the gas constant Kg based on the motor current or motor voltage, and detect that a variation rate of the load F or gas constant Kg changes before the piston reaches the discharge unit when the piston moves close to the discharge unit during the reciprocating motion, so as to prevent the piston from colliding with the discharge unit. The controller may detect that the variation rate of the load F or gas constant Kg changes when the piston 503 moves into the pressure changing unit 711 before reaching the VDS ②.

Figure 8A:
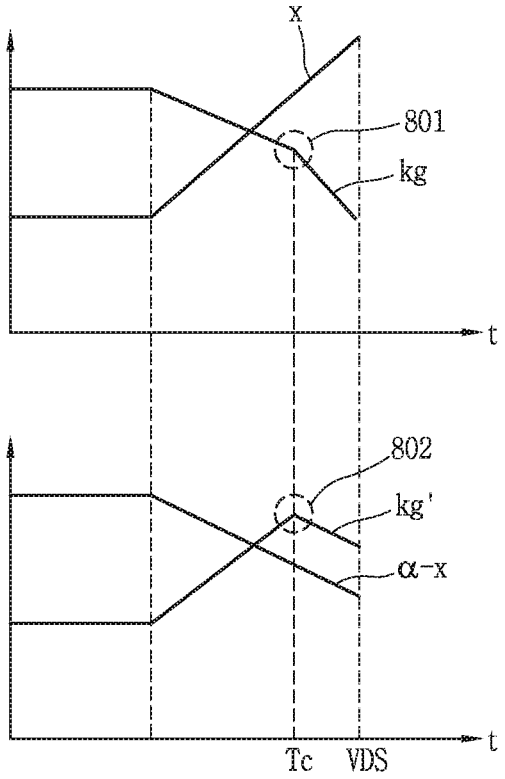
FIGS. 8A to 8C are graphs showing time-based changes in various parameters used for controlling the compressor according to an embodiment.
Figure 8B:
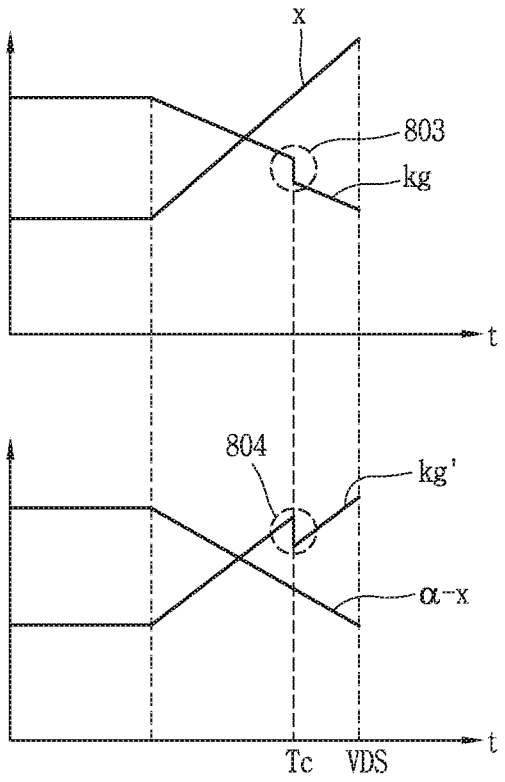
Figure 8C:
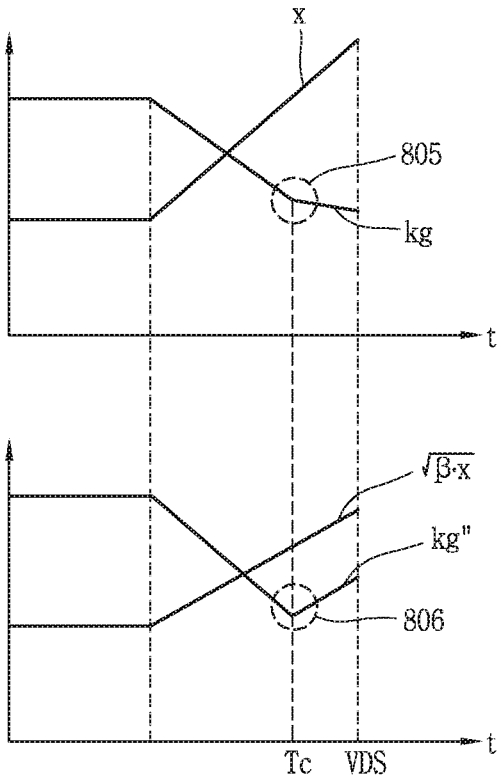

FIGS. 8A to 8C are graphs showing time-based changes in various parameters used for controlling the compressor on a time basis according to the embodiments of the linear reciprocating motion of the piston illustrated in FIGS. 5A, 6A, and 7A.

As illustrated in FIG. 8A, the controller of the compressor according to embodiments may calculate in real time a gas constant Kg associated with the reciprocating motion of the piston, using detected motor current and motor voltage and an estimated stroke.

The controller may calculate the gas constant Kg using the following Equation 2.

$$k_g = \alpha \times \left|\frac{I(jw)}{X(jw)}\right| \times \cos(\theta_{i,x}) + mw^2 - k_m \quad \text{[Equation 2]}$$

Where, I(jw) denotes a peak value of a current for one cycle, X(jw) denotes a peak value of a stroke for one cycle, a denotes a motor constant or counter electromotive force, θi,x denotes a phase difference between a current and a stroke, m denotes a moving mass of the piston, w denotes an operating frequency of a motor, $K_m$ denotes a mechanical spring constant.

Also, Equation 3 related to the gas constant Kg is derived by the above equation.

$$k_g \propto \left|\frac{I(jw)}{X(jw)}\right| \times \cos(\theta_{i,x}) \quad \text{[Equation 3]}$$

That is, the calculated gas constant Kg may be in proportion to the phase difference between the motor current and the stroke.

Therefore, the controller may detect based on the calculated gas constant Kg the time point at which the pressure applied to the piston or the variation rate of the pressure changes. That is, the controller may detect the gas constant Kg in real time and detect based on the calculated gas constant Kg the time point Tc at which the pressure applied to the piston or the pressure variation rate changes. In this instance, the controller may determine that a time point at which a variation rate of the calculated gas constant Kg changes more than a preset or predetermined value (801) corresponds to the time point Tc that the pressure applied to the piston or the pressure variation rate changes.

Referring to FIG. 8A, however, it is difficult to detect the time point Tc that the pressure applied to the piston or the pressure variation rate is changed by the pressure changing unit, merely based on the changes in the gas constant Kg. That is, in the related art TDC control, the controller of the linear compressor determines formation or non-formation of the inflection point of the gas constant Kg and uses the determination result as a basis of determining whether the piston reaches the TDC. However, as illustrated in FIG. 8A, the variation of the gas constant Kg may not be great enough to be detected by the controller before and after the time point Tc at which the pressure or the pressure variation rate changes.

Therefore, referring to FIG. 8A, the controller of the compressor according to embodiments may calculate a parameter Kg' associated with the movement or position of the piston using the estimated stroke, the detected motor current, and the detected motor voltage. In this instance, the calculated parameter may form an inflection point 802 before the piston reaches the VDS during the reciprocating motion. That is, the controller may calculate the parameter forming the inflection point before the piston reaches the VDS during the reciprocating motion, using at least one of the stroke, the motor current, or the motor voltage and a preset or predetermined transformation equation. In addition, the controller may control the motor based on a time point at which the calculated parameter forms the inflection point.

According to this control method, the TDC control for preventing the collision between the piston and the discharge unit of the linear compressor may be effectively executed even without using a separate sensor.

The linear compressor or its control device according to an embodiment may include a memory that stores information related to at least one transformation equation for calculating a parameter. The memory may be disposed or provided in the controller itself or installed in the compressor, separate from the controller. In addition, the controller may calculate the parameter associated with the movement or position of the piston in real time using the information related to the transformation equation stored in the memory and an estimated stroke value. For example, the parameter calculated by the transformation equation may form an inflection point at a time point at which the variation rate of the pressure applied to the piston changes before the piston reaches the VDS.

Referring to FIG. 8A, one example of the transformation equation may be $K'g=\alpha-X$. K'g may denote a calculated parameter, X may denote an estimated stroke, and a may denote a preset or predetermined constant. A number 25 may be substituted for one example of a. The controller may calculate using the equation the parameter K'g forming the inflection point at the time point at which the pressure applied to the piston or the variation rate of the pressure changes. Also, as illustrated in FIG. 8B, the parameter K'g calculated by the transformation equation $K'g=\alpha-X$ may form a plurality of inflection points before the piston reaches the VDS.

One example of a transformation equation for calculating a parameter K"g illustrated in FIG. 8C may be $K''g=F/\sqrt{\beta}*X$. Here, K"g may denote a calculated parameter, X may denote an estimated parameter, and β may denote a preset or predetermined constant. The controller may calculate by using the equation the parameter K"g forming the inflection point at the time point at which the pressure applied to the piston or the variation rate of the pressure changes.

Therefore, the controller may calculate the time point at which the pressure applied to the piston or the variation rate of the pressure changes on the basis of at least one of the calculated parameter K'g or parameter K"g. That is, the controller may calculate the parameter K'g or the parameter K"g in real time, and detect the time point at which the pressure applied to the piston or the variation rate of the pressure changes on the basis of the calculated parameter K'g or K"g. In this instance, the controller may determine that a time point (not illustrated) at which a variation rate of the calculated parameter K'g or K"g changes more than a preset or predetermined value corresponds to the time point at which the pressure applied to the piston or the variation rate of the pressure changes. For example, the time point at which the pressure applied to the piston or the pressure variation rate may correspond to the time point Tc at which the parameter K'g or K"g forms the inflection point.

The controller may compare a plurality of control variables transformed by a plurality of transformation equations when information related to the plurality of transformation equations is stored in the memory, and drive the motor based on the comparison result. For example, the controller may drive the motor to switch the moving direction of the piston when at least one of the plurality of control variables transformed by the plurality of transformation equations forms the inflection point.

In addition, the controller may detect the time point Tc at which the inflection point of the calculated parameter is formed, and control the motor to prevent the piston from colliding with the valve plate based on the detected time point Tc. The controller may control the motor to switch the moving direction of the piston after a lapse of a preset or predetermined time interval from the detected time point Tc. The preset time interval may be changed by the user.

The controller may detect the variation rate of the calculated parameter in real time, and determine that a time point (not illustrated) that the detected variation rate changes more than a preset value corresponds to the formation time point Tc of the inflection point.

Figure 9:
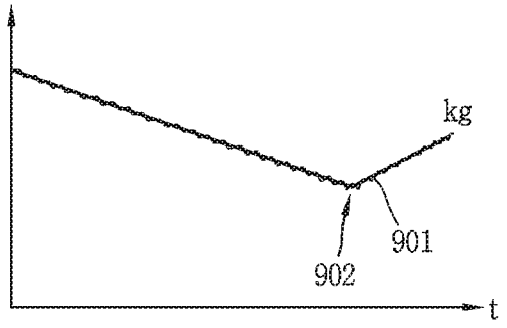
FIG. 9 is a graph showing a trend line associated with a parameter used for controlling a compressor according to an embodiment.

FIG. 9 is a graph illustrating a trend line related to a parameter used for controlling the compressor according to embodiments. As described above, the controller of the compressor according to embodiments may calculate a gas constant Kg related to the movement or position of the piston using the motor current, the motor voltage, or the estimated stroke.

However, the motor current and the motor voltage are measured at a predetermined period and the measured motor current and motor voltage do not change at a constant slope. Therefore, the controller may generate a trend line of the parameter.

Similarly, as illustrated in FIG. 9, observing time-based changes in a measurement value 901 of the gas constant Kg, the variation rate frequently changes and the inflection point is formed. Therefore, it is not proper to be used for the compressor control. Therefore, the controller of the compressor according to embodiments may generate a trend line 902 with respect to the gas constant Kg and control the linear motor based on the trend line information.

Also, the controller may calculate a parameter associated with a position of the piston based on a detected motor current, generate a trend line associated with the calculated parameter, and control the linear motor based on the trend line information. A slope of the trend line may change before the piston reaches the VDS during the reciprocating motion.

Figure 10A:
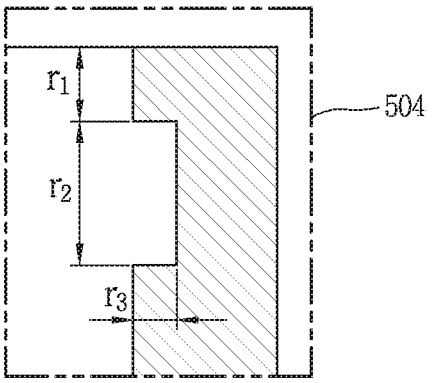
FIG. 10A to 10C is a conceptual view illustrating a detailed embodiment of a pressure changing unit or device of a compressor according to an embodiment.

FIG. 10A illustrates one embodiment of a pressure changing unit or device 504 of a compressor according to embodiments. The pressure changing unit 504 may be disposed or provided between a top dead center (TDC) and a bottom dead center (BDC) of the cylinder.

The pressure changing unit 504 may include a groove formed within the cylinder. As illustrated in FIG. 10A, one end of the groove may be located at a position spaced apart from one end of the cylinder or the VDS of the cylinder by a first distance $r_1$. A width of the groove may be a second distance $r_2$. A depth of the groove may be a third distance $r_3$.

For example, the first distance may be included in a range of about 1.5 mm to about 3 mm. In another example, the third distance may be included in a range of about 2 mm to about 4 mm. In another example, the second distance may be included in a range of about 0.3 mm to about 0.4 mm.

The memory may include information related to the groove. In this instance, the controller may detect the time point at which the pressure applied to the piston or the variation rate of the pressure changes, and control the motor to prevent the piston from reaching the VDS based on the stored information related to the groove. For example, the groove-related information may include at least one of information related to the width of the groove, information related to the depth of the groove and information related to a distance between the one end of the groove and the VDS.

Figure 10B:
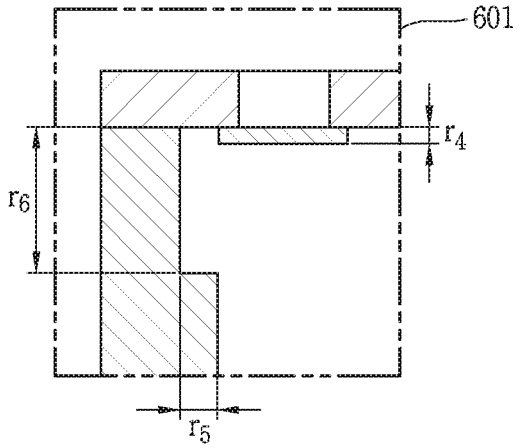

Hereinafter, one embodiment of a pressure changing unit or device 601 of a compressor according to embodiments will be described with reference to FIG. 10B. Referring to FIG. 10B, the pressure changing unit 601 may be provided on one end of the cylinder. That is, the pressure changing unit 601 may be brought into contact with the valve plate or the discharge unit.

As illustrated in FIG. 10B, the pressure changing unit 601 may include a groove formed on one end portion of the cylinder. In this instance, a width of the groove formed on the one end portion of the cylinder may be a sixth distance $r_6$. A depth of the groove may be a fifth distance $r_5$.

The memory may store information related to the fifth and sixth distances $r_5$ and $r_6$ of the groove. Also, the memory may store information related to a fourth distance $r_4$ by which one surface of a suction valve extends from the valve plate when the discharge unit is provided with the suction valve. In this instance, the controller may detect the time point at which the pressure applied to the piston or the variation rate of the pressure changes, and control the motor to prevent the piston from reaching the VDS based on the stored information related to the groove.

Figure 10C:
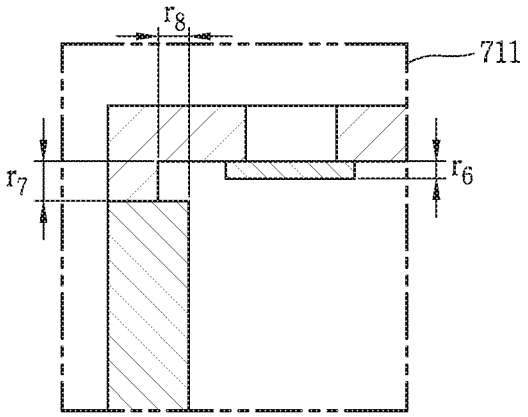

Hereinafter, one embodiment of a pressure changing unit or device 711 of a compressor according to embodiments will be described with reference to FIG. 10C. Referring to FIG. 10C, the pressure changing unit or device 711 may be formed by the discharge unit at outside of the cylinder. That is, the pressure changing unit 711 may be formed by an area difference between a surface of the cylinder which is brought into contact with the discharge unit and a surface of the discharge unit which is brought into contact with the cylinder.

As illustrated in FIG. 10C, the pressure changing unit 711 may include a groove formed from a contact surface between the discharge unit and the cylinder to one surface of the discharge unit. In this instance, a width of the groove may be a seventh distance $r_7$. A depth of the groove may be an eighth distance $r_8$.

The memory may store information related to the seventh and eighth distances $r_7$ and $r_8$ of the groove. Also, the memory may store information related to a fourth distance $r_4$ by which one surface of a suction valve extends from the valve plate when the discharge unit is provided with the suction valve. In this instance, the controller may detect the time point at which the pressure applied to the piston or the variation rate of the pressure changes, and control the motor to prevent the piston from reaching the VDS based on the stored information related to the groove.

In a linear compressor and a method for controlling a linear compressor according embodiments, collision between a piston and a discharge valve may be prevented so as to reduce noise generated in the linear compressor. Also, the prevention of the collision between the piston and the discharge valve may result in a reduction of abrasion of the piston and the discharge valve caused due to the collision, thereby extending a lifespan of mechanisms and components of the linear compressor.

Also, in the linear compressor and the method for controlling a linear compressor according to embodiments, fabricating costs of the discharge valve may be reduced, and fabricating costs of the linear compressor may be reduced accordingly. In addition, noise reduction and high-efficiency operation may simultaneously be obtained even without an addition of a separate sensor.

Embodiments disclosed herein provide a linear compressor capable of reducing noise by preventing collision between a piston and a discharge valve even without employing a separate sensor, and a method for controlling a linear compressor. Embodiments disclosed herein further provide a linear compressor capable of executing a high efficiency operation while reducing noise, and a method for controlling a linear compressor. Embodiments disclosed herein also provide a linear compressor capable of reducing noise generation and fabricating costs.

To achieve these and other advantages and in accordance with the purpose of this specification, as embodied and broadly described herein, there is provided a compressor that may include a piston performing a reciprocating motion within a cylinder, a linear motor to supply a driving force for the motion of the piston, a discharge unit or device to allow a refrigerant compressed in the cylinder to be discharged in response to the motion of the piston, and a pressure changing unit or device to change a variation rate of pressure applied to the piston before the piston reaches a virtual discharge surface (VDS) during the reciprocating motion, to prevent the piston from colliding with the discharge unit. The virtual discharge surface may be brought into contact with at least part of the discharge unit facing a compression space within the cylinder. In one embodiment disclosed herein, the compressor may further include a sensing unit or sensor to detect a motor voltage or motor current of the linear motor, and a controller to determine whether or not the variation rate of the pressure applied to the piston has changed using the detected motor voltage or motor current, and control the linear motor based on the determination result.

In one embodiment disclosed herein, the controller may detect a time point that the variation rate of the pressure applied to the piston changes, and control the linear motor to prevent the piston from reaching the discharge unit based on the detected time point. In one embodiment disclosed herein, the controller may calculate the variation rate of the pressure applied to the piston, form a trend line based on the calculated variation rate of the pressure, and determine that the variation rate of the pressure applied to the piston has changed when a slope of the formed trend line changes.

In one embodiment disclosed herein, the controller may control the linear motor to switch a moving direction of the piston after a lapse of a preset or predetermined time interval from the detected time point. In one embodiment disclosed herein, the controller may determine whether or not the piston has moved over the virtual discharge surface based on information related to the motor current or motor voltage and a stroke, and change the preset time interval when it is determined that the piston has moved over the virtual discharge surface.

In one embodiment disclosed herein, the compressor may further include a memory to store information related to changes in the motor current, the motor voltage, and the stroke during the reciprocating motion of the piston, and the controller may determine whether or not the piston has moved over the virtual discharge surface on the basis of the changes.

In one embodiment disclosed herein, the discharge unit may be disposed on or at one end of the cylinder, and the pressure changing unit may be disposed or provided between the one end of the cylinder having the discharge unit disposed thereon and another end of the cylinder. In one embodiment disclosed herein, the pressure changing unit may be disposed or provided between the one end of the cylinder having the discharge unit disposed thereon and a central portion of the cylinder.

In one embodiment disclosed herein, the pressure changing unit may include a groove spaced apart from at least part of the discharge unit and formed on an inner wall of the cylinder. In one embodiment disclosed herein, the pressure changing unit may include a groove formed by the discharge unit and the one end of the cylinder.

In one embodiment disclosed herein, the discharge unit may include a discharge valve to discharge a refrigerant compressed in the cylinder therethrough, and a valve plate to support the discharge valve. The valve plate may be fixed to the one end of the cylinder.

In one embodiment disclosed herein, the pressure changing unit may include a groove formed by the valve plate at an outside of the cylinder. In one embodiment disclosed herein, the discharge unit may further include a suction valve to suck a refrigerant into the cylinder therethrough, and the valve plate may support the suction valve. In one embodiment disclosed herein, the compressor may further include a suction unit disposed on an end of the piston to suck the refrigerant into the cylinder therethrough.

A compressor according to another embodiment may include a piston performing a reciprocating motion within a cylinder, a linear motor to supply a driving force for the motion of the piston, a discharge unit or device disposed or provided on one end of the cylinder to allow a refrigerant compressed in the cylinder to be discharged in response to the motion of the piston, a sensing unit or sensor to detect a motor current of the linear motor, a controller to calculate a stroke of the piston using the detected motor current, generate a parameter associated with a position of the piston using the motor current and the calculated stroke, and control the linear motor based on the generated parameter, and a changing unit or device to change a variation rate of the generated parameter before the piston reaches a virtual discharge surface (VDS) within the cylinder during the reciprocating motion. The virtual discharge surface may be formed by at least part of the discharge unit facing the cylinder. In one embodiment disclosed herein, the generated parameter may be a gas constant Kg associated with the reciprocating motion of the piston.

In one embodiment disclosed herein, the controller may detect a time point that the variation rate of the parameter changes, and control the linear motor to switch a moving direction of the piston after a lapse of a preset or predetermined time interval from the detected time point, to prevent collision between the piston and the discharge unit. In one embodiment disclosed herein, the controller may control the linear motor to switch a moving direction of the piston after a lapse of a preset or predetermined time interval from the detected time point.

A compressor according to another embodiment may include a piston performing a reciprocating motion within a cylinder, a linear motor to supply a driving force for the motion of the piston, a discharge unit or device disposed or provided on or at one end of the cylinder to allow a refrigerant compressed in the cylinder to be discharged in response to the motion of the piston, a sensing unit or sensor to detect a motor current of the linear motor, a controller to calculate a stroke of the piston using the detected motor current, calculate a phase difference between the motor current and the calculated stroke, and control the linear motor based on the calculated phase difference, and a changing unit or device to change a variation rate of the calculated phase difference before the piston reaches a virtual discharge surface (VDS) during the reciprocating motion. The virtual discharge surface may be formed on at least part of the discharge unit facing the cylinder.

In one embodiment disclosed herein, the controller may detect a time point that the variation rate of the calculated phase difference changes, and control the linear motor to prevent the piston from colliding with the discharge unit based on the detected time point. In one embodiment disclosed herein, the controller may control the linear motor to switch a moving distance of the piston after a lapse of a preset or predetermined time interval from the detected time point.

A compressor according to another embodiment disclosed herein may include a piston performing a reciprocating motion within a cylinder, a linear motor to supply a driving force for the motion of the piston, a discharge unit or device to allow a refrigerant compressed in the cylinder to be discharged in response to the motion of the piston, and a controller to control the linear motor. The controller may generate a preset or predetermined signal before the piston reaches the discharge unit when the piston moves close to the discharge unit during the reciprocating motion, to prevent collision between the piston and the discharge unit.

In one embodiment disclosed herein, the compressor may further include a sensing unit or sensor to detect a motor voltage or motor current of the linear motor, and the controller may generate the preset signal using the detected motor voltage or motor current. In one embodiment disclosed herein, the controller may determine that the piston is spaced apart from the discharge unit by a preset or predetermined distance while moving close to the discharge unit, on the basis of a time point that the preset signal is generated. In one embodiment disclosed herein, the controller may control the linear motor to switch the moving direction of the piston after a lapse of a preset or predetermined time interval from the generation time point of the preset signal.

A compressor according to another embodiment disclosed herein may include a piston performing a reciprocating motion within a cylinder, a linear motor to supply a driving force for the motion of the piston, a discharge unit or device to discharge a refrigerant compressed within the cylinder therethrough in response to the motion of the piston, an additional volume unit or device provided within the cylinder to prevent collision between the piston and the discharge unit, a sensing unit or sensor to detect a motor voltage or motor current of the linear motor, and a controller to determine whether or not the piston has passed through an arranged position of the additional volume unit within the cylinder using the detected motor voltage or motor current, and control the linear motor based on the determination result. In one embodiment disclosed herein, a compression space of the cylinder may include a first volume formed by a surface brought into contact with at least part of an inner wall of the cylinder and the discharge unit, and a second volume formed by the additional volume unit.

In one embodiment disclosed herein, the additional volume unit may change a load applied to the piston when the piston passes through the arranged position of the additional volume unit within the cylinder during the reciprocating motion. In one embodiment disclosed herein, the controller may control the linear motor to switch the moving direction of the piston after a lapse of a preset or predetermined time interval from a time point that the piston passes through the arranged position of the additional volume unit within the cylinder.

Further scope of applicability will become more apparent from the detailed description given hereinafter. However, it should be understood that the detailed description and specific examples, while indicating embodiments, are given by way of illustration only, since various changes and modifications within the spirit and scope will become apparent to those skilled in the art from the detailed description.

It will be apparent to those skilled in the art that various modifications and variations can be made without departing from the spirit or scope. Thus, it is intended that embodiments cover modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a piston that performs a reciprocating motion within a cylinder;

a linear motor that supplies a driving force to the piston;

a discharge device through which a refrigerant compressed in the cylinder by the reciprocating motion of the piston is discharged;

a pressure changing device to change a variation rate of pressure applied to the piston before the piston reaches a virtual discharge surface (VDS) during the reciprocating motion, to prevent the piston from colliding with the discharge device, wherein the virtual discharge surface is brought into contact with at least a portion of the discharge device facing a compression space within the cylinder;

a sensor that detects a motor voltage or motor current of the linear motor; and a controller that determines whether the variation rate of the pressure applied to the piston has changed using the detected motor voltage or motor current, and controls the linear motor based on a determination result, wherein the controller detects a time point at which the variation rate of the pressure applied to the piston changes, and controls the linear motor to switch a moving direction of the piston after a lapse of a predetermined time interval from the detected time point.

2. The compressor of claim 1, wherein the controller calculates the variation rate of the pressure applied to the piston, forms a trend line based on the calculated variation rate of the pressure, and determines that the variation rate of the pressure applied to the piston has changed when a slope of the formed trend line changes.

3. The compressor of claim 1, wherein the controller determines whether the piston has moved over the virtual discharge surface based on information related to the motor current or motor voltage and a stroke, and changes the predetermined time interval when it is determined that the piston has moved over the virtual discharge surface.

4. The compressor of claim 3, further including a memory that stores information related to changes in the motor current, the motor voltage, and the stroke during the reciprocating motion of the piston, wherein the controller determines whether the piston has moved over the virtual discharge surface on the basis of the changes.

5. The compressor of claim 1, wherein the discharge device is provided at a first end of the cylinder, and wherein the pressure changing device is provided between the first end of the cylinder at which the discharge device is provided and a second end of the cylinder.

6. The compressor of claim 5, wherein the pressure changing device is provided between the first end of the cylinder at which the discharge device is provided and a central portion of the cylinder.

7. The compressor of claim 5, wherein the pressure changing device includes a groove spaced apart from at least a portion of the discharge device and formed on an inner wall of the cylinder.

8. The compressor of claim 5, wherein the pressure changing device includes a groove formed by the discharge device and the first end of the cylinder.

9. The compressor of claim 1, wherein the discharge device includes:

a discharge valve to discharge a refrigerant compressed in the cylinder therethrough; and a valve plate to support the discharge valve, wherein the valve plate is fixed to the first end of the cylinder.

10. The compressor of claim 9, wherein the pressure changing device includes a groove formed by the valve plate at an outside of the cylinder.

11. The compressor of claim 9, wherein the discharge device includes a suction valve to suck a refrigerant into the cylinder therethrough, wherein the valve plate supports the suction valve.

12. The compressor of claim 9, further including a suction device provided on an end of the piston to suction the refrigerant into the cylinder therethrough.

13. A compressor, comprising:

a piston that performs a reciprocating motion within a cylinder;

a linear motor that supplies a driving force to the piston;

a discharge device provided at a first end of the cylinder through which a refrigerant compressed by the reciprocating motion of the piston in the cylinder is discharged;

a sensor that detects a motor current of the linear motor;

a controller that calculates a stroke of the piston using the detected motor current, generates a parameter associated with a position of the piston using the motor current and the calculated stroke, and controls the linear motor based on the generated parameter; and a changing device that changes a variation rate of the generated parameter before the piston reaches a virtual discharge surface (VDS) within the cylinder during the reciprocating motion, wherein the virtual discharge surface is formed by at least a portion of the discharge device facing the cylinder, and wherein the controller detects a time point at which the variation rate of the generated parameter changes, and controls the linear motor to switch a moving direction of the piston after a lapse of a predetermined time interval from the detected time point, to prevent collision between the piston and the discharge device.

14. The compressor of claim 13, wherein the generated parameter is a gas constant Kg associated with the reciprocating motion of the piston.

15. A compressor, comprising:

a piston that performs a reciprocating motion within a cylinder;

a linear motor that supplies a driving force to the piston;

a discharge device provided at an end of the cylinder through which a refrigerant compressed in the cylinder by the reciprocating motion of the piston is discharged;

a sensor that detects a motor current of the linear motor;

a controller that calculates a stroke of the piston using the detected motor current, calculates a phase difference between the motor current and the calculated stroke, and controls the linear motor based on the calculated phase difference; and a changing device that changes a variation rate of the calculated phase difference before the piston reaches a virtual discharge surface (VDS) during the reciprocating motion, wherein the virtual discharge surface is formed on at least a portion of the discharge device facing the cylinder, wherein the controller detects a time point at which the variation rate of the calculated phase difference changes, and controls the linear motor to switch a moving direction of the piston after a lapse of a predetermined time interval from the detected time point.

* * * * *